US007861461B2

(12) United States Patent
Nakano

(10) Patent No.: US 7,861,461 B2
(45) Date of Patent: Jan. 4, 2011

(54) METHOD FOR AUTOMATICALLY OPENING DOOR AND DEVICE FOR AUTOMATICALLY OPENING AND CLOSING DOOR

(75) Inventor: Yasuo Nakano, Tamura (JP)

(73) Assignee: Yuki Corporation, Fukushima (JP)

( * ) Notice: Subject to any disclaimer, the term of this patent is extended or adjusted under 35 U.S.C. 154(b) by 0 days.

(21) Appl. No.: 12/680,726

(22) PCT Filed: Sep. 24, 2008

(86) PCT No.: PCT/JP2008/067142

§ 371 (c)(1),
(2), (4) Date: Jun. 28, 2010

(87) PCT Pub. No.: WO2009/041406

PCT Pub. Date: Apr. 2, 2009

(65) Prior Publication Data

US 2010/0263287 A1 Oct. 21, 2010

(30) Foreign Application Priority Data

Sep. 28, 2007 (JP) ..... 2007-252878
Apr. 18, 2008 (JP) ..... 2008-109069
Jul. 22, 2008 (JP) ..... 2008-189019

(51) Int. Cl.
*E05D 15/06* (2006.01)

(52) U.S. Cl. ..... 49/231; 49/226; 49/228; 49/229; 49/230; 49/409; 49/324; 49/273; 49/274; 49/327; 49/328; 49/329

(58) Field of Classification Search ..... 49/32, 49/226, 227, 228, 229, 230, 231, 409, 324, 49/263, 273, 274, 327, 328, 329, 356
See application file for complete search history.

(56) References Cited

FOREIGN PATENT DOCUMENTS

| | | |
|---|---|---|
| JP | H05-118180 | 5/1993 |
| JP | H05-231063 | 9/1993 |
| JP | UM H06-37482 | 5/1994 |

*Primary Examiner*—Katherine W Mitchell
*Assistant Examiner*—Catherine A Kelly
(74) *Attorney, Agent, or Firm*—Muramatsu & Associates

(57) ABSTRACT

A door opening and closing device for a slide door, which can be horizontally open and close the slide door by application of a light load and which can be constructed and maintained at low costs. The door opening and closing device has a transmission mechanism for converting through a lever (31) the amount of settlement of a tread plate (21) placed on floor surfaces at positions in front and back of the slide door (12), into a predetermined displacement amount. The tread plate (21) is weight-wise balanced such that the transmission mechanism and settlement of the tread plate due to the weight of an adjustment weight (W) causes the tread plate (21) to float through the lever (31). Up-down movement of the long transmission member (32) presses a drive rotation body (42) to an open door rail (41), and a component force of the pressing force allows the slide door (12) to be opened by application of a light load.

7 Claims, 21 Drawing Sheets

METHOD FOR AUTOMATICALLY OPENING DOOR AND DEVICE FOR AUTOMATICALLY OPENING AND CLOSING DOOR

FIELD OF THE INVENTION

The present invention relates to a method for automatically opening a door to open a slide door of a doorway by applying a bodyweight of a human stepping on, and to a device for automatically opening and closing a door using the same.

BACKGROUND OF THE INVENTION

There have been many applications with respect to a mechanism for opening and closing a slide door of a doorway by using a load displacement caused by a load of stepping-on of a human body as a source of power without using additional source of power such as electric motor.

For example, Japanese Laid Open Utility Number HOG-37482 discloses a method (incline method) that uses an amount of displacement caused by a stepping on to appropriately incline a guide rail positioned on an upper or a lower portion of a slide door by a link mechanism toward a desired moving direction, and thereby slidably moving the slide door along the incline.

However, the incline method noted above has a drawback in that a responsive and quick movement is difficult since it depends solely on the natural movement along the incline caused by the own weight of the slide door, and frequent entering and exiting is burdensome.

Moreover, it has a drawback in that when dust etc. is accumulated at the guide rail due to long use, this method is easily affected adversely. In addition, it has a drawback that when the application force transmission mechanism configured as noted above is impaired, opening and closing manually becomes impossible or very difficult. Patent Document 1: Japanese Laid Open Utility Publication Number H06-37482

DISCLOSURE OF THE INVENTION

Problems to be Solved by the Invention

The present invention provides a method for automatically opening a door and a device for automatically opening and closing a door that overcomes the inadequacy of quick responsiveness to the stepping-on, and the lack of operational reliability caused by the variance of setting condition and stepping-on weight in the conventional method. Moreover, it provides a method for automatically opening a door and a device for automatically opening and closing a door that is not affected very much even when a transmission mechanism is impaired, and construction cost is low as well as a maintenance operation is easy, and has high technical feasibility.

Means to Solve the Problems

In order to achieve the above objectives, the present invention is configured as follows:

A method for automatically opening and closing a door according to the first aspect of the invention is characterized in that by applying weight perpendicularly to a rail that is inclined to one side of an opening or a closing direction of the door, thereby moving the door toward the opening direction.

In the configuration according to the first aspect of the invention, when the weight is applied perpendicularly to the rail that is inclined downward to either side of the door, a component force toward the opening direction operates as an open door biasing force to bias the door to the opening direction and the door will move to the opening direction.

A device for automatically opening and closing a door according to the second aspect of the invention of the present invention is characterized in having: a tread plate that is arranged to be freely moveable up and down; a suspend door rail that is inclined downwardly toward a closing direction of the door; a door support body that supports the door to the suspend door rail in a freely moveable manner; an open door rail fixed to the door that is inclined downwardly toward an opening direction of the door; and an open door mechanism that applies a pressing force from below to the open door rail by a pressing body that is moveably contacted to the open door rail when the tread plate is depressed.

In the configuration according to the second aspect of the invention, a component force to the closing direction that is generated by the weight of the door supported by the suspend door rail constantly operates as a close door biasing force that biases the door toward the closing direction. When the pressing force is applied from below to the open door rail by the pressing body due to the added weight to the tread plate, the open door biasing force that is a horizontal component force toward the opening direction will exceed the close door biasing force, and the closed door will move toward the opening direction.

A device for automatically opening and closing a door according to the third aspect of the invention of the present invention is further characterized as having an open door supplementary mechanism that constantly applies a pressing biasing force to the open rail by the pressing body from the below to the extent that the movement of the door support body to the closing direction of the door is allowed against the suspend door rail.

In the configuration according to the third aspect of the invention, a component force of perpendicular direction and a component force toward the opening direction of the door are generated by the pressing biasing force from below that is constantly applied by the pressing body to the open door rail. The door is constantly operated with a relatively reduced door close biasing force due to the component force in the perpendicular direction by the pressing biasing force. The open door biasing force that is a component force toward the opening direction of the door by the pressing biasing force is to the extent that is bellow allowing the movement of the door toward the closing direction of the door, and is smaller than the close door biasing force of the door. Even when a part of the body weight of a light weight person such as a child works on the tread plate, the closed door will quickly move toward the opening direction since the open door biasing force that exceeds the close door biasing force that is relatively decreased will work on the door.

A device for automatically opening and closing a door according to the fourth aspect of the present invention is characterized in having: a tread plate that is arranged to be freely moveable up and down; a door supported to be moveable to opening and closing directions; an open door rail fixed to the door that is inclined downwardly toward the opening direction of the door; an open door mechanism that applies a pressing force from below to the open door rail by a pressing body that is moveably contacted to the open door rail when the tread plate is depressed; and a close door biasing mechanism that applies a biasing force to the door toward the closing direction.

In the configuration according to the fourth aspect of the invention, the weight of the door that is supported to the horizontal suspend door rail does not operate the door close biasing force that is a component force toward the closing direction of the door. When the pressing force is applied from below to the open door rail through the pressing body by application of the weight on the tread plate, the open door biasing force that is a horizontal component force toward the opening direction of the door will exceed the close door biasing force, and the closed door will move toward the door opening direction. The biasing force on the door toward the closing direction is applied by the close door biasing mechanism.

A device for automatically opening and closing a door according to the fifth aspect of the present invention is characterized in that the close door biasing mechanism has a pressing biasing force application mechanism that constantly applies a biasing force to the pressing body, wherein the biasing force presses the pressing body to the open door rail from above.

A device for automatically opening and closing a door according to the sixth aspect of the present invention is characterized in further having: a close door rail that is inclined downwardly toward the closing direction of the door and is configured to be separate from the door; and a supplementary pressing mechanism that applies constant a pressing biasing force from above to the close door rail by a supplementary pressing body that is contacted to be freely to the close door rail and is provided to a lever that is supported to be freely swingable to the door.

A device for automatically opening and closing a door according to the seventh aspect of the present invention is further characterized in that the close door biasing mechanism has an upper side pressing body that holds the open door rail therein from above with the pressing body and is contacted to the open door rail to be freely moveable, and applies a biasing force to the door toward the closing direction by applying the biasing force that presses the upper part pressing body to the open door rail from the above.

A device for automatically opening and closing a door according to the eighth aspect of the present invention is further characterized in having an open door supplementary mechanism that constantly applies a pressing biasing force to the open door rail by the pressing body, wherein the pressing biasing force is to the extent that allows movement of the door that is being biased by the close door biasing mechanism toward the closing direction.

The configuration according to the eighth aspect of the invention, a component force of a perpendicularly upward direction and a component force toward the opening direction of the door are generated by the pressing force from below that is constantly applied to the open door rail through the pressing body. The component force toward the perpendicularly upward direction by the pressing force decreases the weight of the door. Thus, the door is constantly applied with a close door biasing force that is relatively decreased. The open door biasing force that is a component force toward the opening direction of the door by the pressing force is to the extent that is below allowing the movement of the door toward the door closing direction, and is smaller than the close door biasing force of the door. Even a body weight of a light weighted person like a child worked on the tread plate will make the open door biasing force to exceed the close door biasing force, and the closed slide door will quickly move toward the opening direction.

In the device for automatically opening and closing a door of the present invention, the following specific configuration can be implemented. A slide door is provided that is suspended and supported to be freely slidable in the opening and closing directions. On each of the front and back floor of the slide door at the location of closed door, a tread plate is provided that is configured to be sunk by a predetermined amount by human body weight.

A transmission mechanism is provided that amplifies the sinking amount of the tread plate into a predetermined stroke amount and raises a transmission elongated part. Due to the weight of the transmission elongated part and the weight that is additionally installed as necessary, the tread plate is balanced to be floated when the human body weight is not applied to the tread plate.

The up and down movement of the transmission elongated part is converted to an open and close movement of the slide door. For example, a drive rotation body provided at the end of the transmission elongated part that moves up and down is pressed to the open door rail that is installed to the slide door in the inclined manner. The pressing force at the contact point becomes a component force toward an inclined direction with reference to a center direction of the drive rotation body. Thereby, a rotation force is generated to the drive rotation body, and thus, the open and close operation of the slide door fixed to the open door rail is performed.

When the slide door is to be closed, a force that operates downward to the slide door, along with the weight of the slide door, can hamper the sliding movement. In order to prevent this, a supplementary rotation body that is separate from the drive rotation body may be provided at an end of a lever that exerts a pressing force for the slide door to be capable of opening and closing by a tension spring and where a fulcrum point is provided at the slide door side.

While this rotation body is between the stroke of opening and closing of the slide door, the elongated part that runs to be freely slidable is fixed with an inclined manner where the closing direction of the slide door is lowered (opening direction is raised). Thus, the slide door is constantly applied with a force toward the closing direction, as well as a force to press up the slide door, thereby effectively reducing the weight of the slide door. Thus, the present invention is characterized in that the horizontal open door operation of the slide door is performed by using the component force as a power source that is obtained by pressing the rotation body to the inclined open door rail. The manner of inclination of the open door rail does not need to be constant. For example, the incline at the lower dead point (when closing the door) may be blunt or acute, thereby increasing or decreasing the speed at the beginning of the door opening.

Effect of the Invention

Since the present invention is configured as described above, the slide door can be swiftly moved to the opening direction in response to the stepping on to the tread plate.

Moreover, since the movement biasing force has been applied toward the closing direction of the slide door, an external force is not necessary to close the door. By using a plurality of slide doors, a large open space can be easily established.

Moreover, since the number of components involved can be reduced because of the simple structure, high reliability with no trouble is possible. By establishing the angle of inclination appropriately, the biasing force can be easily adjusted. The slide door is able to perform open and close movement along the suspend door rail, and the open door biasing force and closing door biasing force of the door and speed can be easily adjusted.

Moreover, even when light weight such as about 10 kg is applied, the door can be automatically opened or closed, and the door can be manually moved to the closing direction when locking up the door. Thus, the device for automatically opening and closing the door that has the effects described above is opened or closed by the human body weight when a human steps on. Thus, it can be easily installed in a location where electric power source for an electric motor cannot be easily secured, for example, a simple outside facility, such as a greenhouse.

Since the device for automatically opening and closing the door of the present invention has high energy efficiency, a light-weighted user is able to operate it.

Moreover, the door itself is used as a part of a drive mechanism, and a drive mechanism or power transmission mechanism are not provided in the door case and door stop areas. Thus, non-moveable fixtures may be installed near the door case or door stop area, thereby enhancing a freedom of construction space. Specifically, it is possible to make transparent almost all surfaces of the door case.

Moreover, friction loss is minimized and energy efficiency is increased. A drive mechanism or power transmission mechanism is not installed at the door case and door stop areas. Thus, the flexibility of layout of setting location is increased, including poles and fixtures.

It is possible to minimize the difference between the biasing force toward the closing direction and the biasing force toward the opening direction of the door when the body weight is not applied to the tread plate due to the open door supplementary mechanism. Thus, when the body weight is applied, the slide door can be swiftly opened. Accordingly, the door can be opened without causing a person using the door to feel a time lag.

Moreover, the weight of the door is reduced by the pressing force for applying the biasing force toward the opening direction, and thus, the kinetic friction against the rail that support the door is reduced. Thus, the loss of biasing power is reduced that operates for opening and closing of the door.

DESCRIPTIONS OF REFERENCE MARKS

Figure 1:
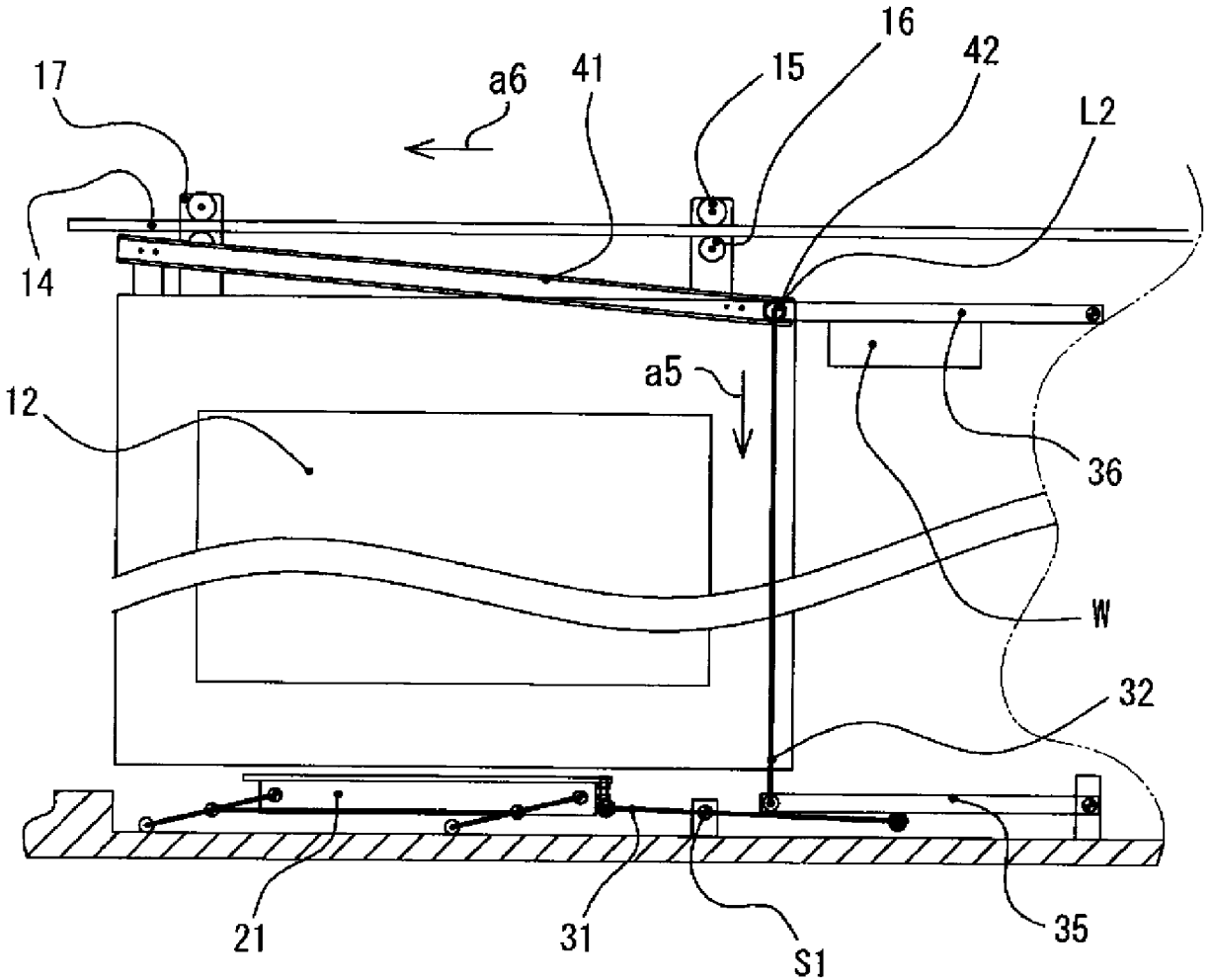
FIG. 1 is an overall front view showing schematically the configuration of the embodiment 1.

10: floor
11: frame
12: slide door
13: open retraction side (door case side)
14: guide rail
15: runner roller
16: latch roller
17: suspend hook
21: tread plate
30: roller
31: lever
32: transmission elongated part
33*a*, 33*b*: slide rail
35: lower crank lever
35*a*: displacement amplification lever
36: upper crank lever
41: open door rail
41*a*: open door rail
41*b*: supplementary rail
42: drive rotation body
42*a*: drive rotation body
42*b*: supplementary rotation body
43: lever
44: tension spring
S1: fulcrum point A
S2, S2*a*: fulcrum point B
S3, S3*a*: fulcrum point C
L1: link 1
L2: link 2
a1: arrow 1
a2: arrow 2
a3: arrow 3
a4: arrow 4
a5: arrow 5
a6: arrow 6
W, Wa, Wb: adjustment weight, weight
120: slide door
140: suspend door rail
210: tread plate
150: runner roller
410: open door rail
420: drive rotation body

700: drive mechanism
800: door case

BEST MODES FOR IMPLEMENTING THE INVENTION

Next, embodiments that implement the above described configuration will be described in detail with reference to drawings. FIG. 1 is an overall front view schematically showing the configuration of the embodiment 1. FIGS. 2, 3, 4 and 5 are partial front views showing the operation condition of the embodiment 1.

Embodiment 1

The embodiment 1 shown in FIG. 1 depicts a configuration where there is one slide door 12 (one-way drawn door). A runner roller 15 that is pivotally supported is provided through suspension hooks 17 located at upper two locations of the slide door 12. The slide door 12 is slidable along a guide rail 14 by positioning the runner rollers 15 that are rotatable along the guide rail 14 arranged along the open/closing direction.

On area of the floor surface 10 at locations of front and back of the slide door 12 when the slide door 12 is closed is arranged tread plates 21 at about the same surface of the floor surface 10. The tread plates 21 are configured so as to sink in a predetermined amount (about 10-20 mm) by a stepping-on of a human.

A transmission mechanism is arranged that transmits the sink-in amount of the tread plate 21 as a stroke amount (move amount) from the lower part of the tread plate 21 to an open retraction side 13 (door case side). That is, a roller 30 is provided at an end of the door close side adjacent to the lower surface of the tread plate 21, and a roller 30*a* is provided to the other end of the door open side adjacent to the lower surface of a lower crank lever 35. Between the roller 30 and 30*a*, a lever 31 is arranged below the floor surface 10 where the lever 31 is provided with a fulcrum point S1. The lower crank lever 35 has one end at the door open side supported to the floor surface 10 by a fulcrum point S2, and the other end at the door close side liked (link L1) to a transmission elongated part 32.

The transmission elongated part 32 extends along a retraction hole of the open retraction side 13, and is connected (link L2) at the upper end to an upper crank lever 36. The upper crank lever 36 has an end at the door open side supported to a wall, etc. by a fulcrum point S3, and the other end at the door close side connected (link L2) to the transmission elongated part 32. The distance between the link L2 of the upper crank lever 36 and the fulcrum point S3 is made equal to the distance between the link L2 of the lower crank lever 35 and the fulcrum point S2, thereby making the transmission elongated part 32 to roughly move up and down.

At the link L2 of the upper end of the transmission elongated part 32, a drive rotation body 42 as a pressing body is also established. Moreover, one end of an open door rail 41 is fixed to the upper part of the slide door 12 such that the drive rotation body 42 is positioned to be inserted into a groove of the open door rail 41. The other end of the open door rail 41 is fixed with an incline angle, which elevates up along the closing direction of the slide door 12, that is appropriate to opening and closing of the slide door 12. The drive rotation body 42 is freely slidable in the groove of the open door rail 41.

An adjustment weight W is provided at the upper crank lever 36. Due to the adjustment weight and the weight of the transmission elongated part 32, the drive rotation body 42 is constantly applied with a biasing force (arrow a5) that presses the lower surface of the groove of the open door rail 41 from the above. As a result, the slide door 12 is applied with a biasing force (arrow a6) to the closing direction. The slide door 12 is opened and closed by the mechanism configured as described above.

Effect of Embodiment 1

Figure 2:
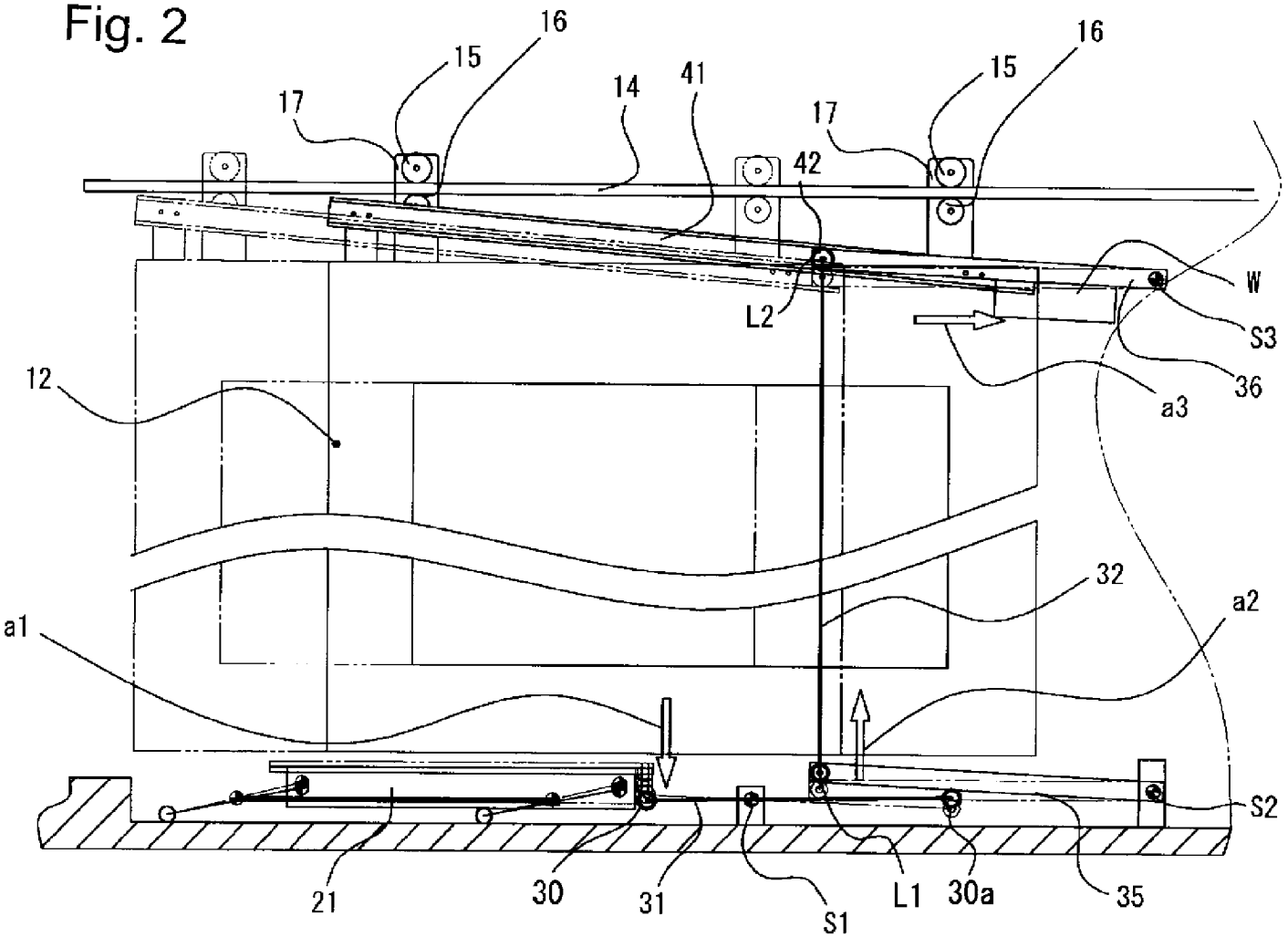
FIG. 2 is a partial front view showing the operational condition of the embodiment 1.
Figure 3:
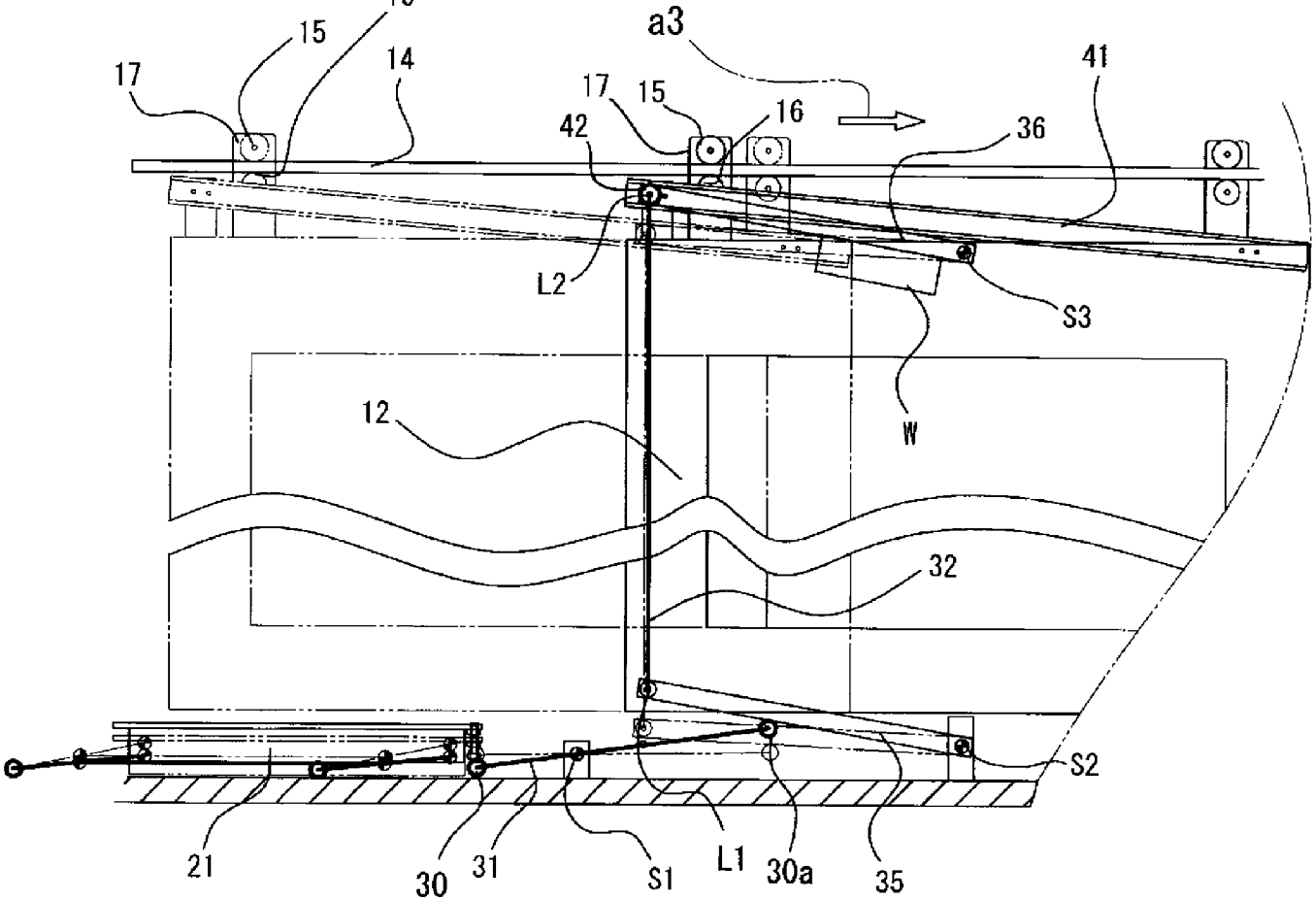
FIG. 3 is a partial front view showing the operational condition of the embodiment 1.

In the embodiment 1, in the open door condition of FIG. 2, due to the weight of the transmission elongated part 32 and the adjustment W (refer to FIGS. 1 and 2), the transmission elongated part 32 is biased downwardly (arrow a5), which is pressing down the lower surface of the groove of the open door rail 41 and biases the slide door 12 to the closing direction (arrow a6). When, as shown in FIG. 3, a weight is applied to the tread plate 21 from the close door condition and the tread plate 21 is depressed (arrow a1), the transmission elongated part 32 is moved upwardly (arrow a2), and the drive rotation body 42 presses up the upper surface of the groove of the open door rail 41. Due to the component force at the contact point, the slide door 12 moves to the opening direction (arrow a3).

Figure 4:
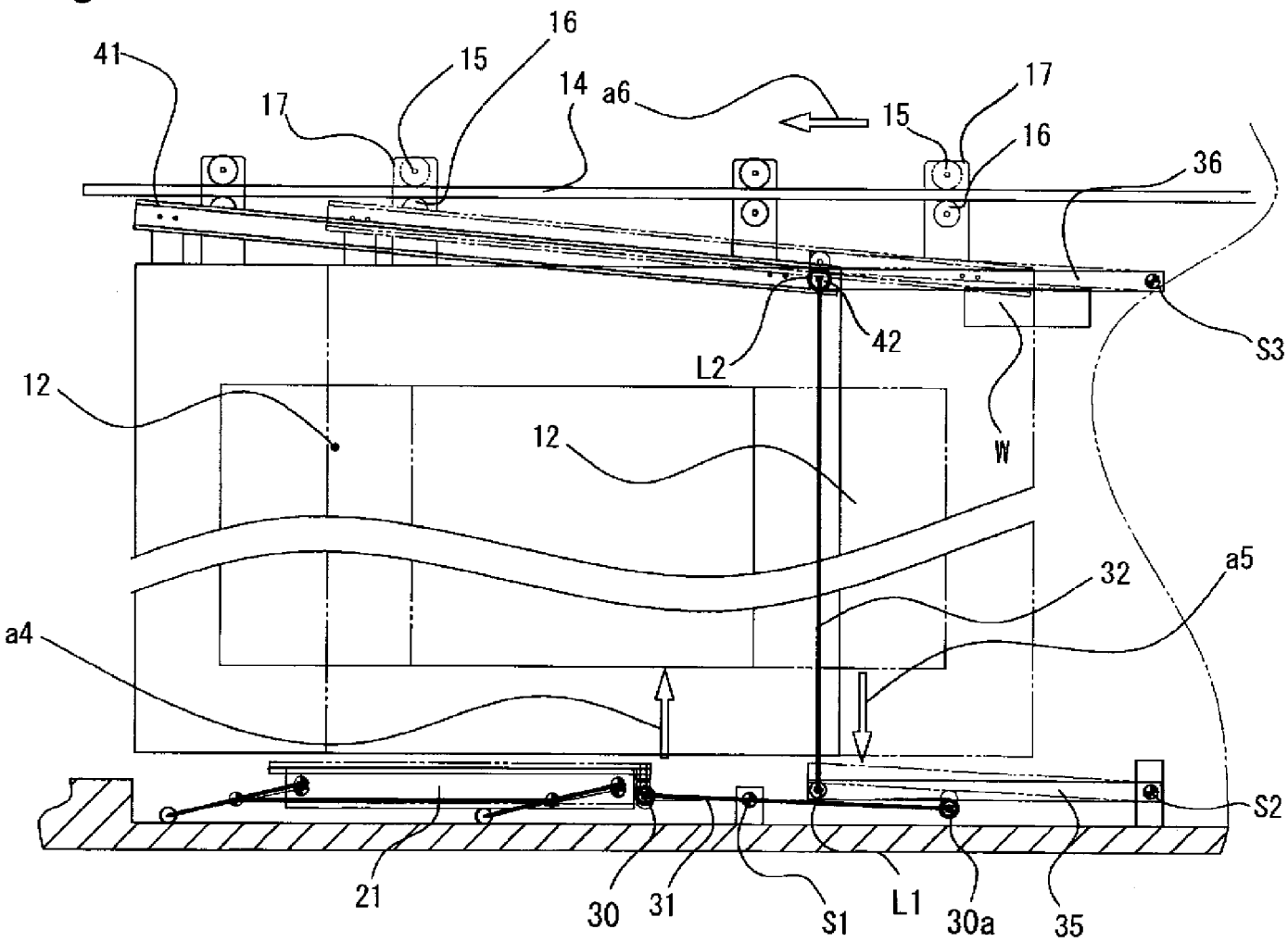
FIG. 4 is a partial front view showing the operational condition of the embodiment 1.
Figure 5:
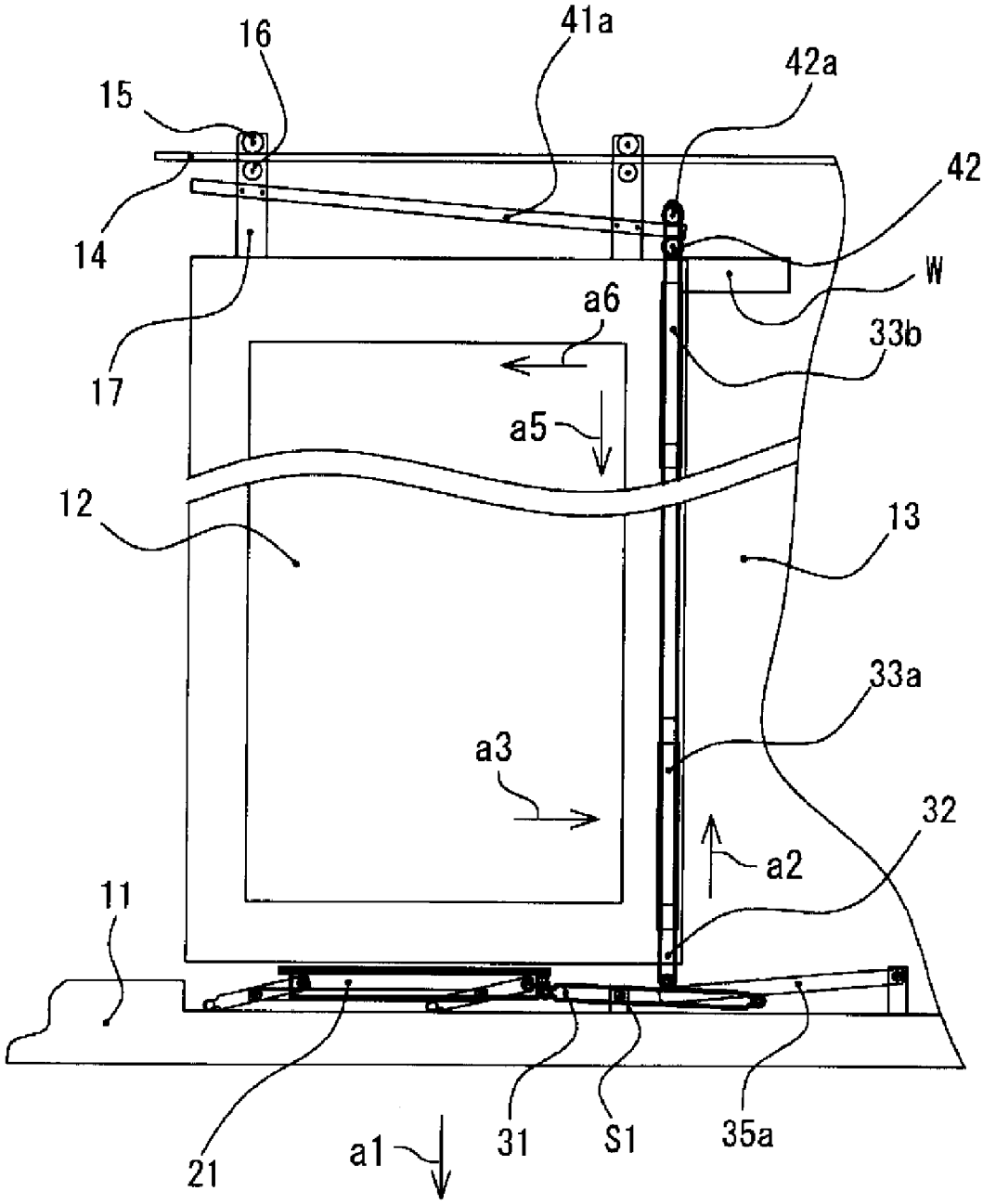
FIG. 5 is a partial front view showing the operational condition of the embodiment 1.

Further, as shown in FIG. 4, due to the pressing-up by the drive rotation body 42, the slide door 12 moves to the completely open condition (arrow a3). Then, when the weight on the tread plate 21 is no longer applied, as shown in FIG. 5, due to the weight of the transmission elongated part 32 and the adjustment weight W (refer to FIGS. 1 and 2), the transmission elongated part 32 is moved downwardly (arrow a5), which presses down the lower surface of the groove of the open door rail 41 and the slide door 12 is moved to the closing direction (arrow a6). At the same time, the tread plate 21 is moved upward (arrow a4).

In the embodiment 1, the up and down speed of the tread plate 21 corresponds to the opening and closing speed of the slide door 12 since the groove of the open door rail 41 fixed to the slide door 12 holds the drive rotation body 42 therein.

Thus, by providing an open/close speed control mechanism for the slide door 12, abrupt up and down movements of the tread plate 21 can be prevented without regard to the weight applied to the tread plate 21.

Figure 6:
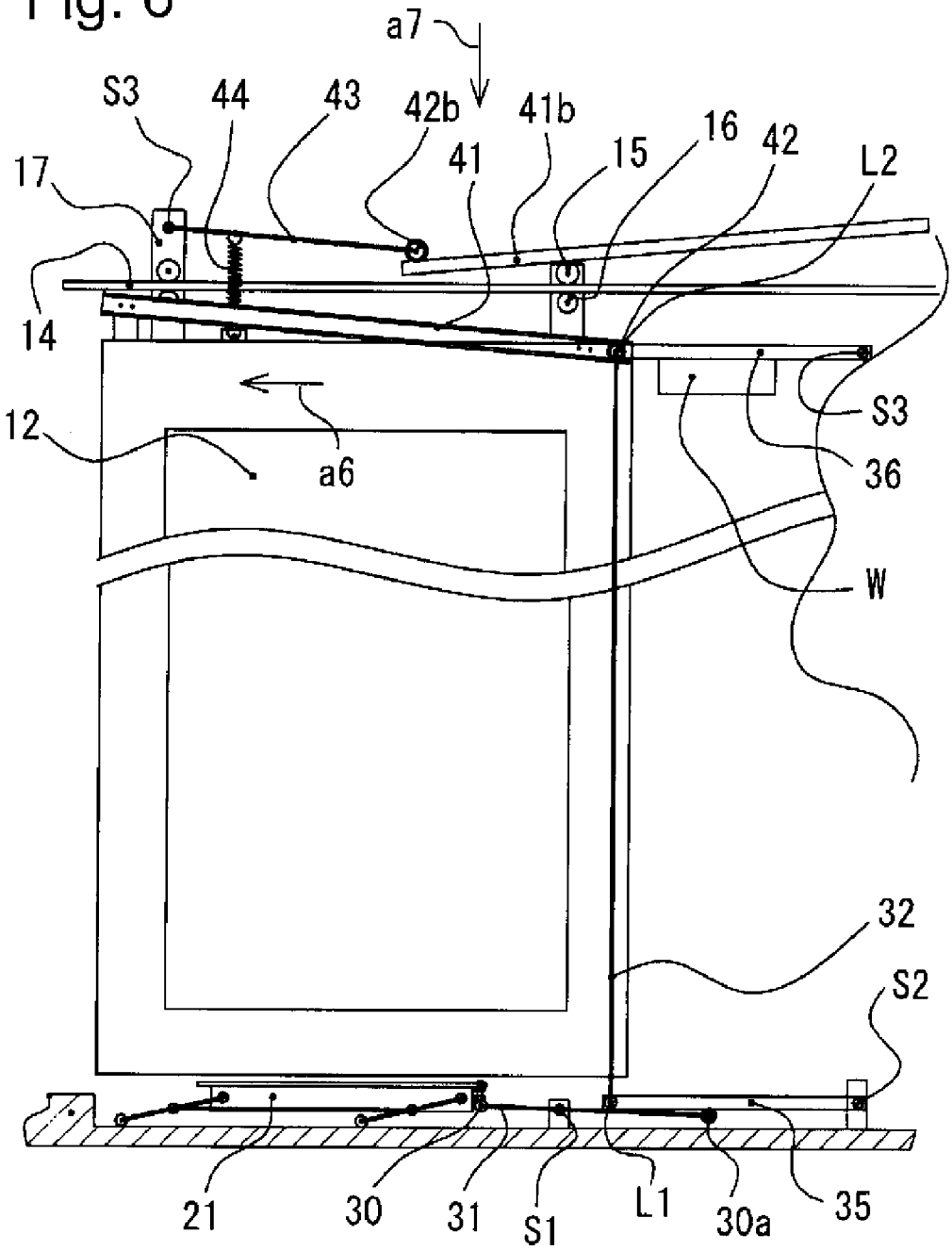
FIG. 6 is an overall front view showing schematically another configuration of the embodiment 1.

The mechanism shown in FIG. 6 is another mechanism of equivalent operational principle. Although it is the same from the tread plate 21 to the lever 31, it uses a displacement amplification lever 35*a* instead of the crank mechanism, and uses a slide rails 33*a* and 33*b* to support the up and down slide of the transmission elongated part 32. The adjustment weight W is established at the upper side of the transmission elongated part 32. An open door rail 41*a* uses a grooveless rod or a plate, and holds drive rotation bodies 42 and 42*a*. Due to the weight of the transmission elongated part 32 and the adjustment weight W, a biasing force that presses the open door rail 41*a* is constantly applied to the drive rotation body 42*a* as an upper side pressing body.

When the weight is applied to the tread plate 21 and the tread plate 21 moves downward (arrow a1), the transmission elongated part 32 is moved upward (arrow a2), and the drive rotation body 42 presses up the open door rail 41*a*, which moves the slide door 12 to the completely opening position (arrow a3). When the weight on the tread plate 21 is no longer applied, due to the weight of the transmission elongated part 32 and the adjustment weight W, the transmission elongated part 32 is moved downward (arrow a5) and the drive rotation body 42*a* presses down the open door rail 41*a*, which moves the slide door 12 to the closing direction (arrow a6). At the same time, the tread plate 21 is moved up (arrow a4). Thus, smooth and stable opening and closing operation of the tread plate 21 is made possible without regard to the amount of the human weight.

With respect to the combination of the drive rotation bodies 42, 42*a* and the open door rail 41*a*, appropriate one may be selected for use such as a bearing and a flat bar of various material, a pinion and a rack, or a sprocket and chain, etc.

Figure 7:
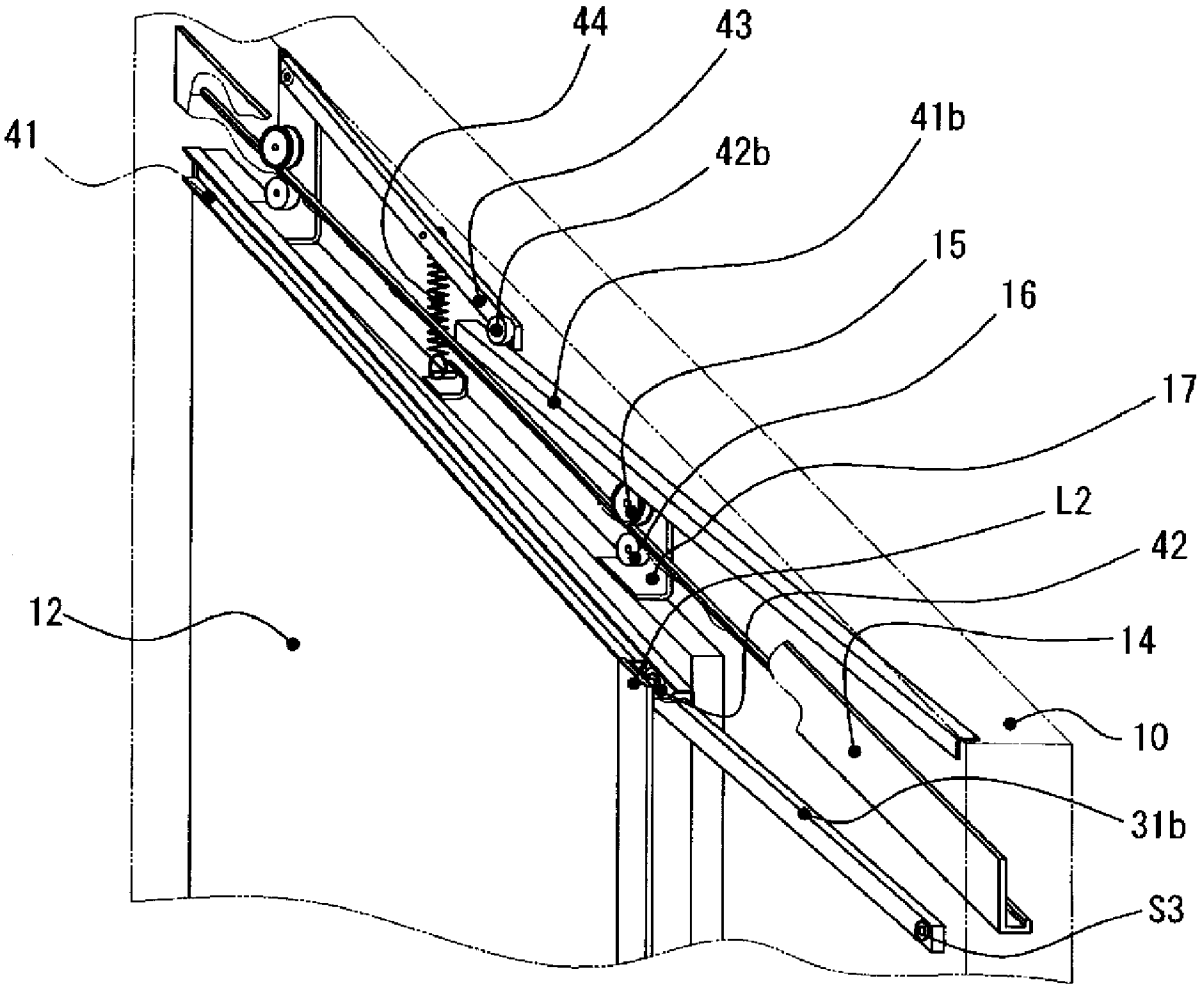
FIG. 7 is an overall front view showing schematically the configuration of the embodiment 2.
Figure 8:
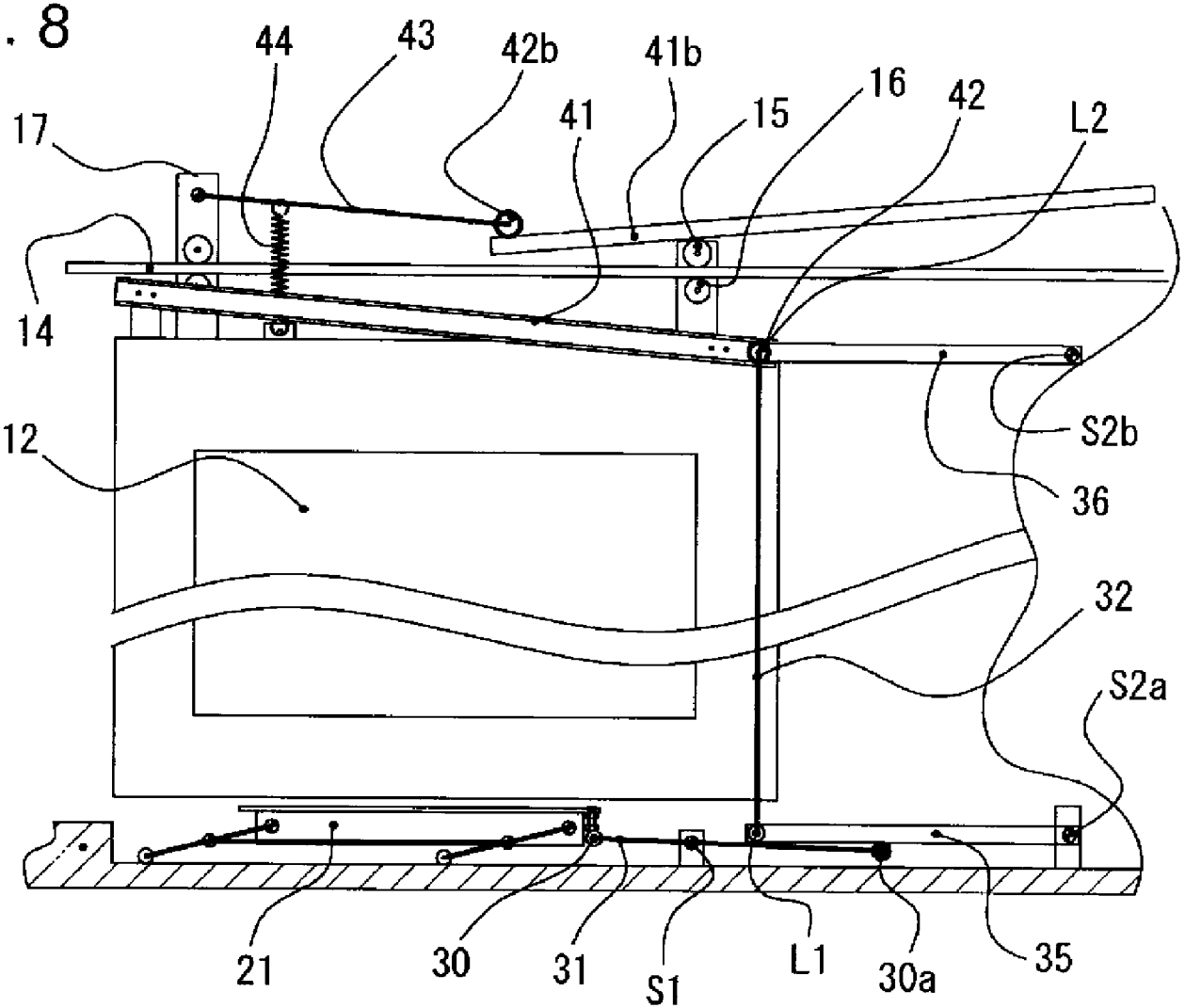
FIG. 8 is a perspective view showing a part of the configuration of the embodiment 2.

FIG. 7 is an overall front view that schematically shows the configuration of the embodiment 2. FIG. 8 is a perspective view showing a main part. FIGS. 9, 10, 11 and 12 are partial front views showing the operational condition of the embodiment 2.

Embodiment 2

The embodiment 2 is configured in such a way to additionally include a supplementary mechanism to the embodiment 1 described above as shown in FIG. 7 and the perspective view of FIG. 8 so that it will function without problem even if the slide door 12 itself weighs more than 30 kg. Thus, description of the same basic configuration part omitted and only the additional part will be described.

In addition to the operational mechanism of the embodiment 1, a part of the open door bias mechanism of the embodiment 1 is arranged as a supplementary mechanism as described in the following.

A fulcrum point S3 is provided to the suspension hook of the slide door 12, and a lever 43 having a supplementary rotation body 42*b* as a supplementary pressing body at one end thereof is provided. A tension spring 44 is provided between the fulcrum S3 of the lever 43 and the supplementary rotation body 42*b* so that the lever 43 presses the upper surface of the supplementary rail 41*b*.

The supplementary rail 41*b* as a closing door rail is configured separately from the slide door 12. The supplementary rail 41*b* is inclined downward from the opening direction to closing direction within an operational distance range (open/close stroke of the slide door 12) of the supplementary rotation body 42*b*, and is fixed to a wall or a guide rail 14, etc.

A pressing force (arrow a7) is constantly applied to the supplementary rail 41*b* by the supplementary rotation body 42*b* through the lever 43 produced by the tension spring 44. Thus, the slide door 12 is constantly applied with a biasing force (arrow a6) toward the closing direction. The tension strength of the tension spring 44 for pulling up the slide door 12 is adjusted to reduce the weight of the slide door 12.

Effect of Embodiment 2

Figure 9:
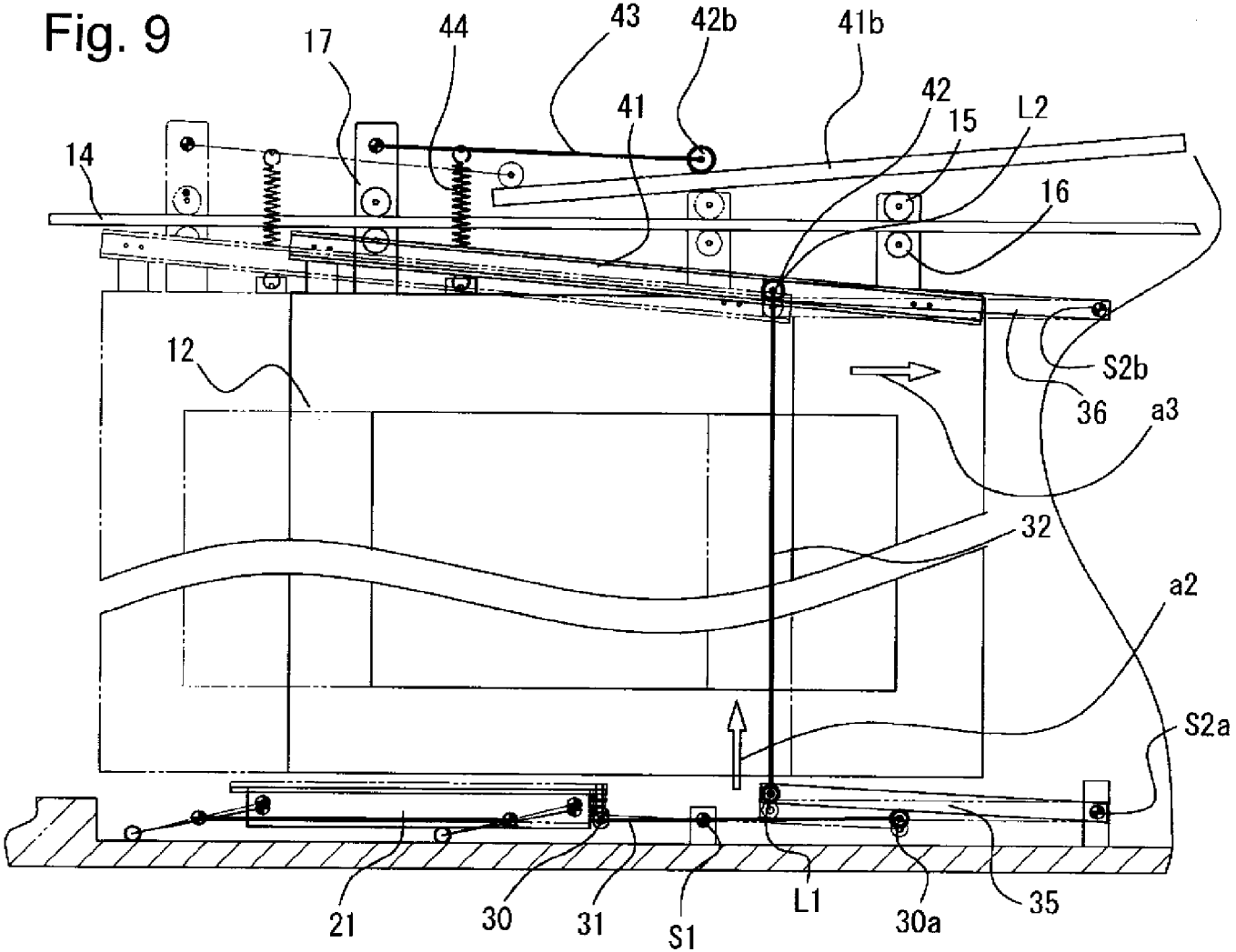
FIG. 9 is a partial front view showing the operational condition of the embodiment 2.
Figure 10:
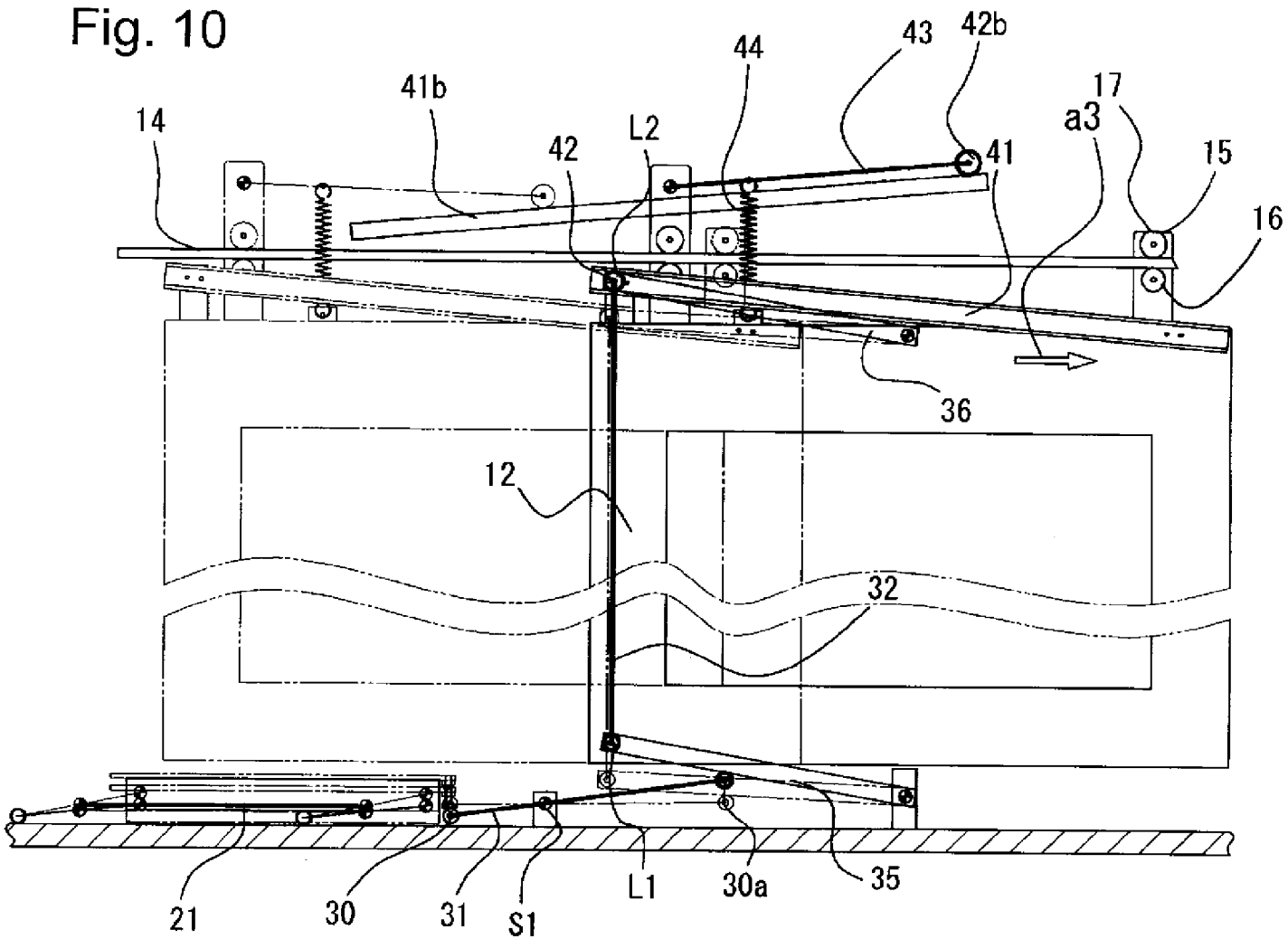
FIG. 10 is a partial front view showing the operational condition of the embodiment 2.

In the embodiment 2, in the closed door condition shown in FIG. 9, the weight of the transmission elongated part and the adjustment weight W bias (arrow a7) the transmission elongated part 32 downwardly. The lower surface of the groove of the supplementary rail 41*b* is pressed down and thus the slide door 12 is biased (arrow a6) to the closing direction. Starting from this closed condition, when weight is applied (arrow a1) to the tread plate 21 as shown in FIG. 10, the transmission elongated part 32 is pressed up (arrow a2) as shown in FIG. 10. Thus, the drive rotation body 42 presses up the open door rail 41. Due to the component force at the contact point, the slide door 12 is moved (arrow a3) toward the opening direction.

Figure 11:
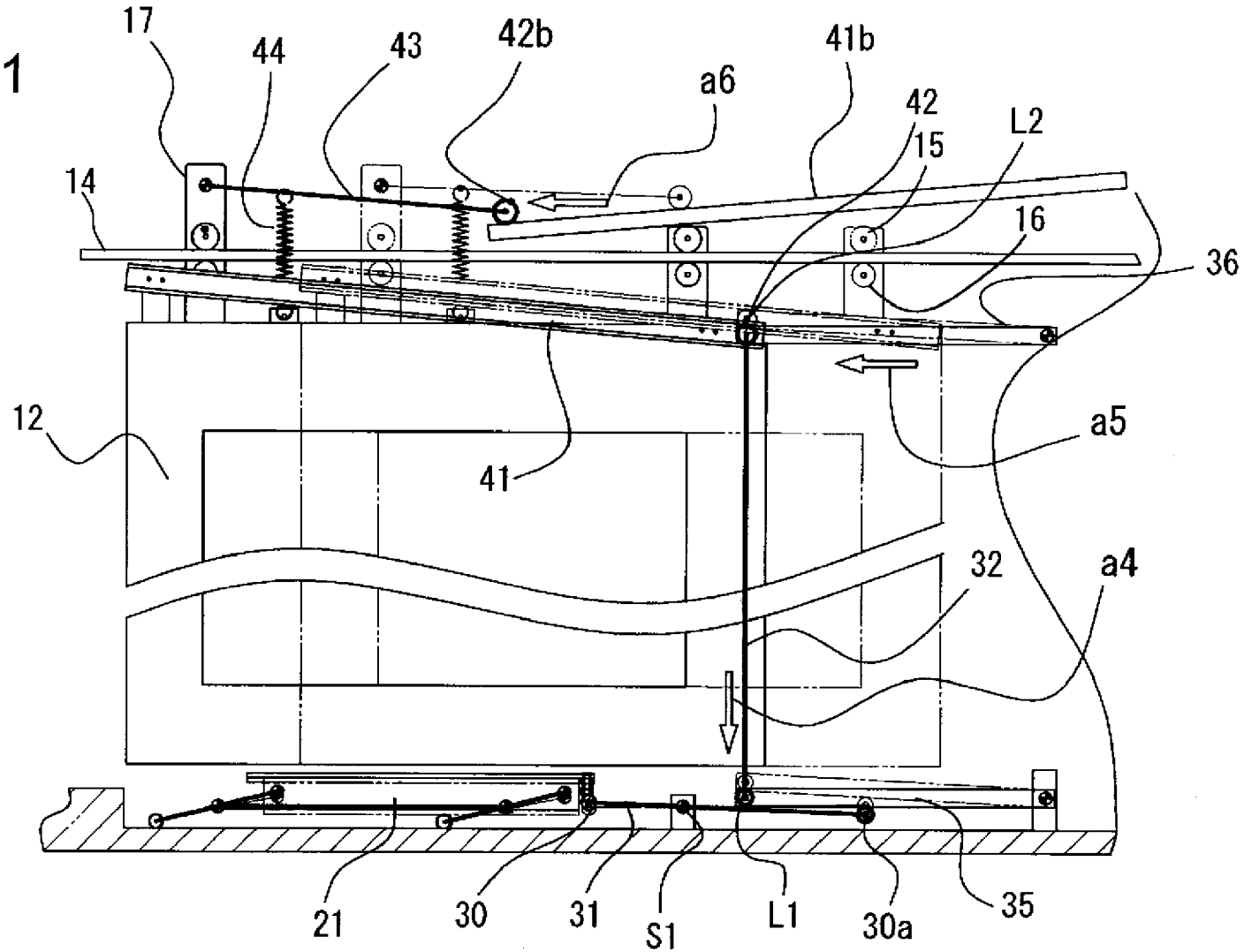
FIG. 11 is a partial front view showing the operational condition of the embodiment 2.

At the same time, the supplementary rotation body 42*b* moves up along the slant of the upper surface of the supplementary rail 41*b* and slides to the opened direction (arrow a3) as shown in FIG. 11. At this time, the tension spring 44 is elongated and stores energy for the closing operation.

Figure 12:
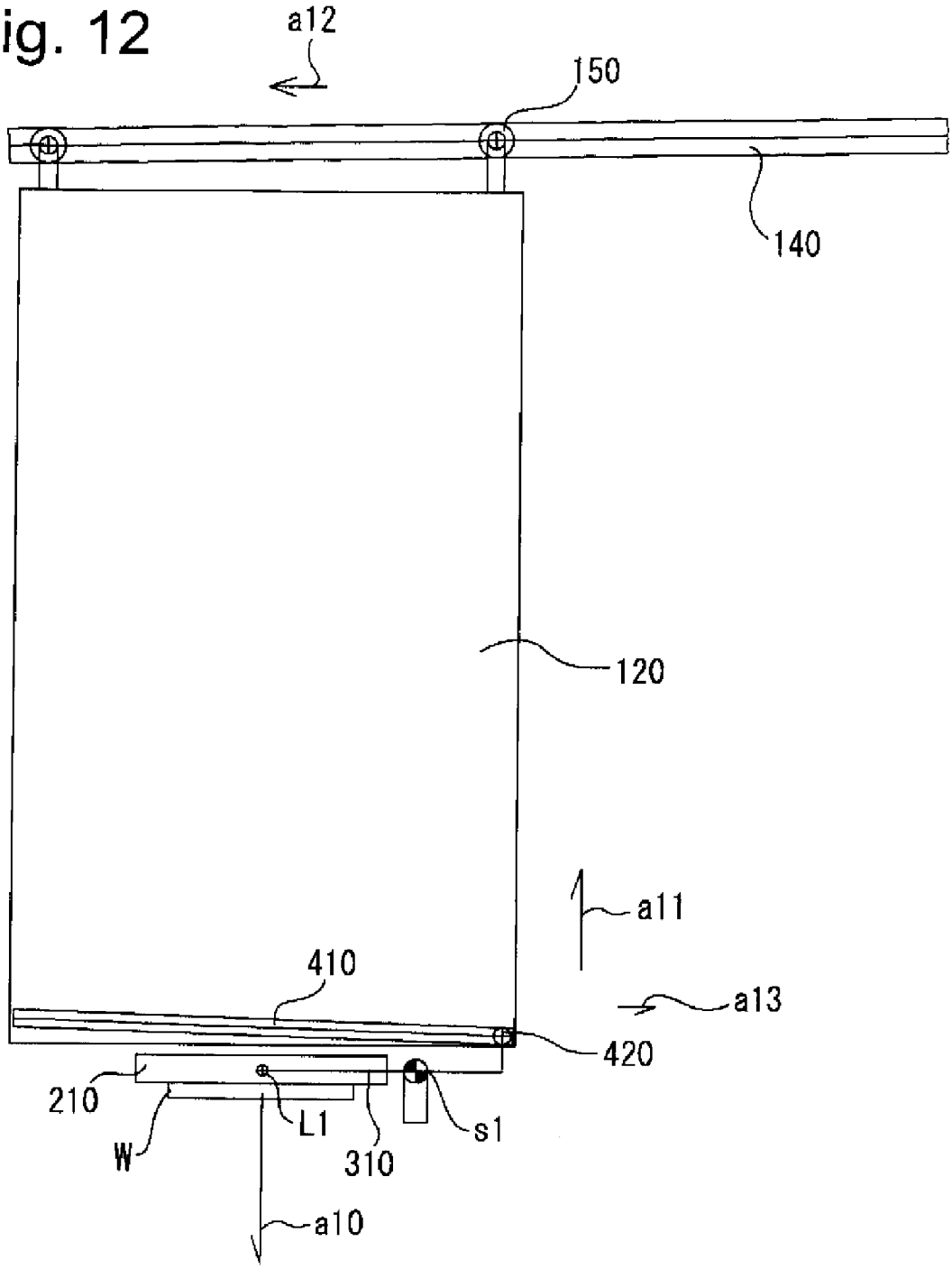
FIG. 12 is a partial front view showing the operational condition of the embodiment 2.

In closing the slide door 12 as shown in FIG. 12, when the weight on the tread plate 21 is no longer applied, the transmission elongated part 32 moves downward (arrow a5) due to the weight of the transmission elongated part 32 and the adjustment weight W. The lower surface of the groove of the open door rail 41 is pressed down, and the slide door 12 is moved toward the closing direction (arrow a6). At the same time, the tread plate 21 is moved upwardly (arrow a4). At this time, the supplementary rotation body 42*b* applies a force (arrow a7) to the supplementary rail 41*b* pulling up the slide door 12, while closing (arrow a6) the slide door 12 by using the stored energy. Thus, smooth opening and closing operation is possible even when there is a pressing force by the weight of the slide door 12 and the drive rotation body 42 that presses the open door rail 41.

Embodiment 3

Figure 13:
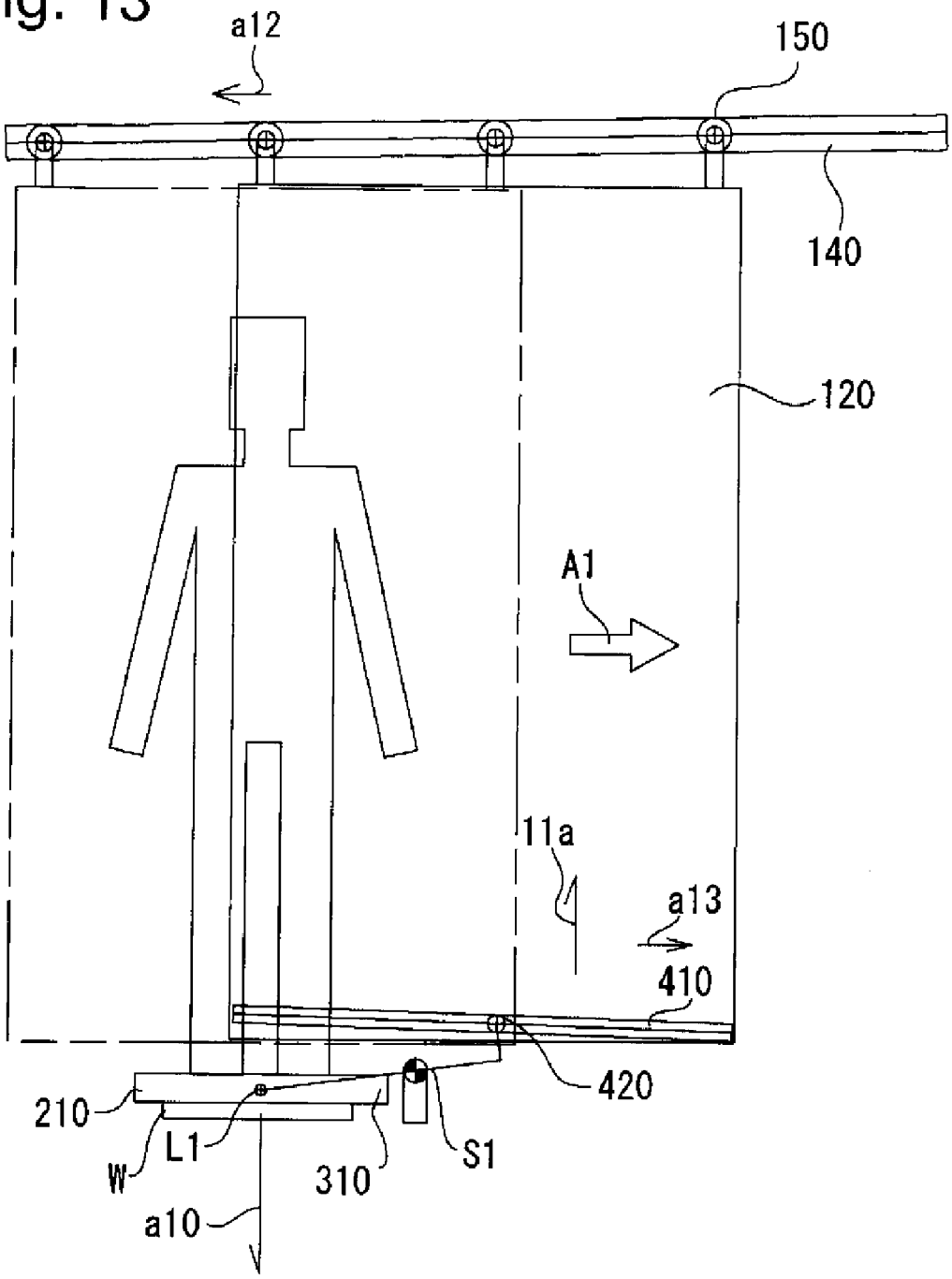
FIG. 13 is a partial front view showing schematically a part of the configuration of the embodiment 3.
Figure 14:
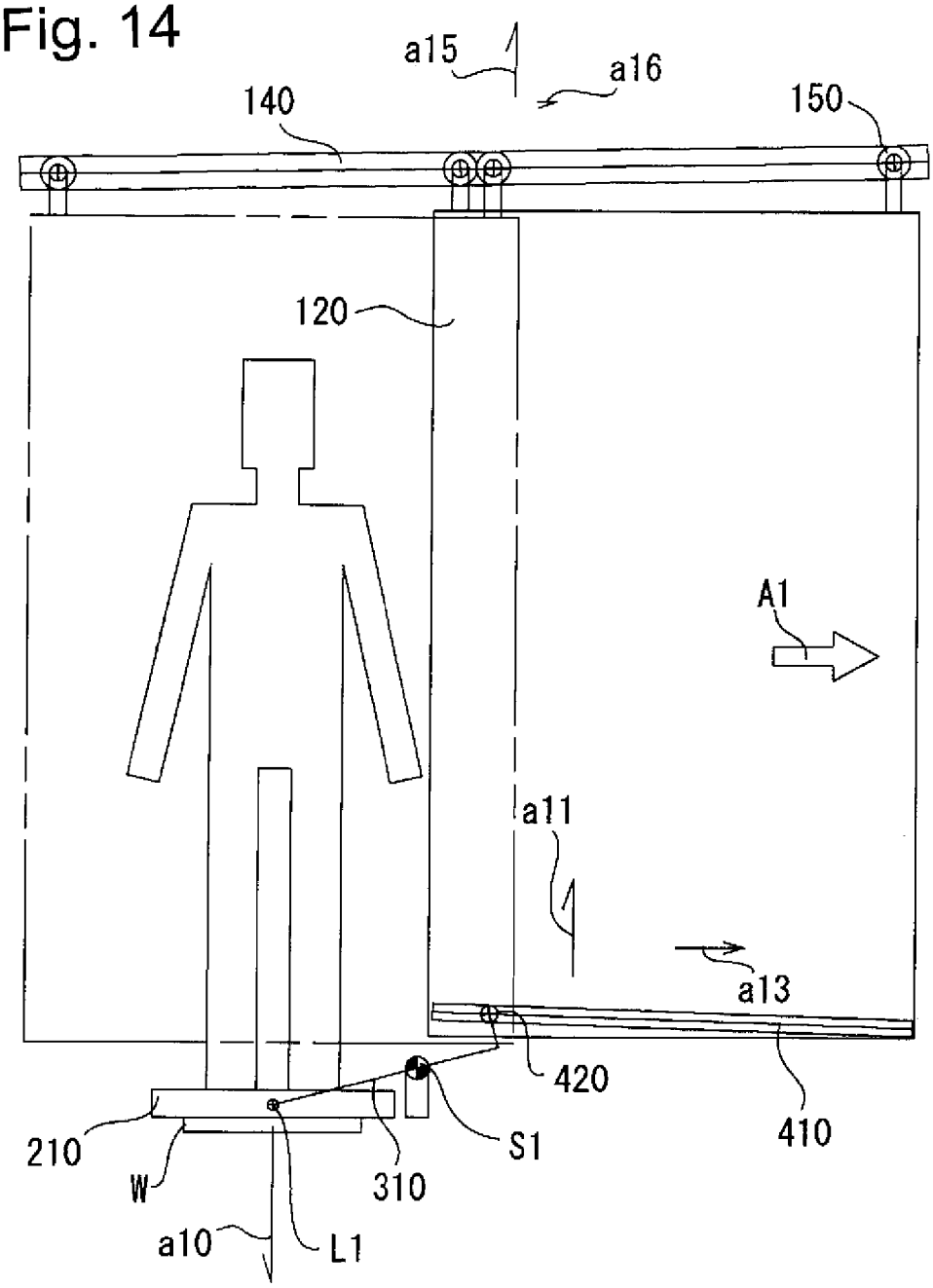
FIG. 14 is a partial front view showing the operational condition of the embodiment 3.
Figure 15:
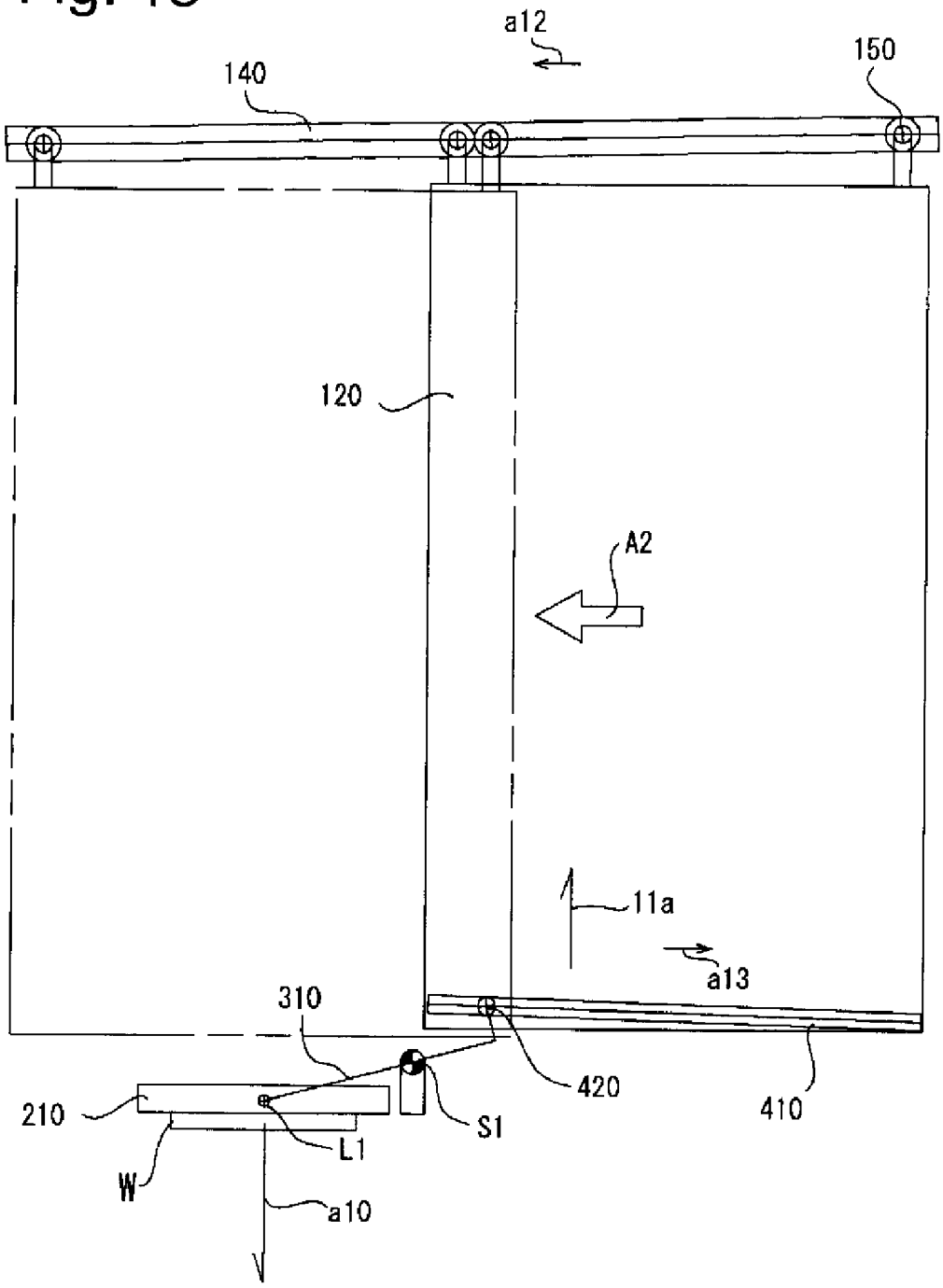
FIG. 15 is a partial front view showing the operational condition of the embodiment 3.
Figure 16:
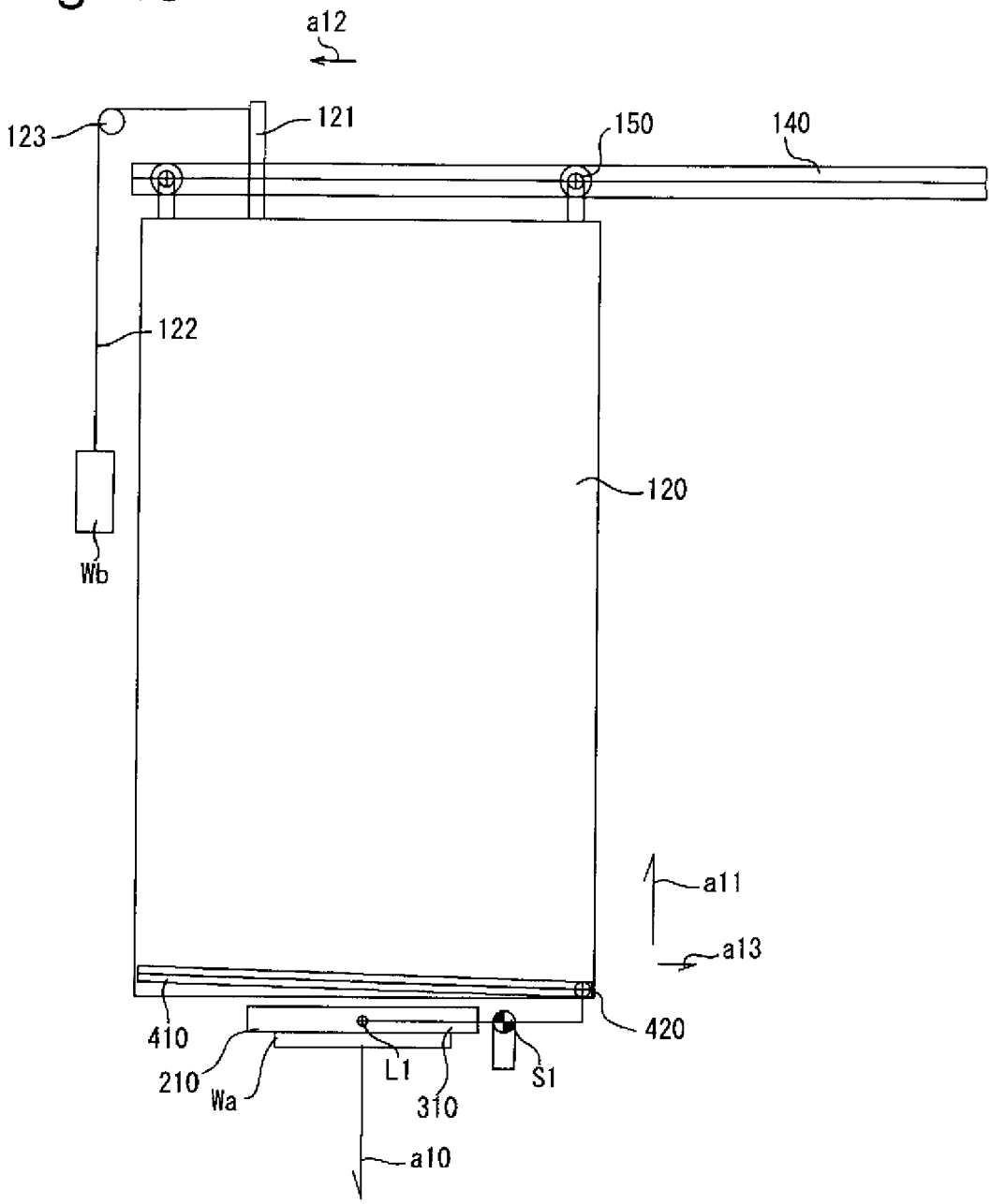
FIG. 16 is a partial front view showing the operational condition of the embodiment 3.

FIG. 13 is a partial front view that schematically shows a part of the configuration of the embodiment 3 of the present embodiment. FIGS. 14-16 are partial front views showing the operational condition of the embodiment 3.

The device for automatically opening and closing a door of the embodiment 3 comprises, at the upper part, a suspend door rail 140 that inclines downwardly toward the closing direction of the slide door 120, a runner roller 150 as a door support body of the hung door, a slide door 120 that is fixed to a suspend door rail 140 through the runner roller 150, an open door rail 410 that is fixed to the slide door 120 with an inclination opposite to that of the suspend door rail 140, a tread plate 21, an open door mechanism that moves up and down the drive rotation body 420 by coordinating with the tread plate 21, and weight W fixed to the tread plate 210.

The open door mechanism applies a pressing force to the open door rail by means of the drive rotation body 420 as a pressing body that is moveably contacted to the open door rail 410 when the tread plate 21 is pressed down. The weight W creates and an open door supplementary mechanism for producing a constant pressing up force that constantly works for the drive rotation body 420. If an opposite incline is used for the incline of the open door rail 410 fixed to the slide door 120 and the suspend door rail 140, the movement direction of the drive rotation body 420 will be downward and the operation direction of force also become opposite.

Due to the constant pressing up biasing force applied by the open door supplementary mechanism, a pressing force that allows movements of the runner roller 150 toward the closing direction of the slide door 120 against the suspend door rail 140 is constantly applied from below to the open door rail 410 by the drive rotation body 420.

Next, the operation of the device for automatically opening and closing the door will be described. As shown in FIG. 13, the initial biasing force (arrow a10) that the open door supplementary mechanism exerts on the tread plate 210 is converted to an upward biasing force by a converting means 310 of the open door mechanism. The upward biasing force is then transmitted to the drive rotation body 420 and thus, the drive rotation body 42 is pressed to the open door rail 410.

Thereby, a constant force that constantly biases the slide door 120 upward is applied to the slide door 120 as a pressing up biasing force (arrow a1*l*) through the open door rail 410. Accordingly, a constant open door biasing force that constantly biases the slide door 120 toward the opening direction is applied to the slide door 120 as a open door biasing force (arrow a13) through the open door rail 410.

The weight of the slide door 120 that is relatively reduced by the constant pressing up biasing force works on the runner roller 150. Thus, a constant close door biasing force that biases the slide door 120 toward the closing direction works on the slide door 120 as a closing door biasing force (arrow a12).

In the condition where weight is not applied to the tread plate 210, the close door biasing force is only slightly larger than the open door biasing force. Thus, body weight of a light weighted person like a child worked on the tread plate 210 will make the open door biasing force to exceed the close door biasing force, and thus, the closed slide door 120 swiftly moves toward the opening direction.

As shown in FIG. 14, when the body weight is applied to the tread plate 210, it is converted to an upward biasing force by the converting means 310 and is transmitted to the drive rotation body 420. Then, it works on the slide door 120 through the open door rail 410. As a result, the pressing up biasing force on the slide door 120 is increased.

When the weight of the slide door 120 is relatively decreased due to the pressing up biasing force that works on the open door rail 410, the closing door biasing force that works on the slide door 120 through the runner roller 150 is also decreased. Moreover, along with the increase of the pressing up biasing force that works on the open door rail 410, the opening door biasing force that works on the slide door 120 through the open door rail 410 is increased. When the open door biasing force that works on the slide door 120 exceeds the closing door biasing force, the slide door 120 will start to move toward the opening direction (arrow A1).

Further, as shown in FIG. 15, when the pressing up biasing force exceeds its own weight of the slide door 120, the pressing up biasing force to the extent it exceeds the weight of the slide door 20 will work as an engaging pressing up biasing force (arrow a15) that presses up the runner roller 150 to the suspend door rail 140. Thus, instead of the closing door biasing force, the pressing up door open biasing force (arrow a16) is applied to the slide door 120 to the opening direction through the runner roller 150. As a result, a resultant combined force of the open door biasing force and the pressing up open door biasing force works on the slide door 120. The slide door 120 increases the moving speed to that extent and moves to the opening direction until it is fully opened.

As shown in FIG. 16, when a body weight is no longer applied to the tread plate 210, a constant open door biasing force as an open door biasing force (arrow a13) is applied to the slide door 120, and a constant close door biasing force as a door close biasing force (arrow a12) is also applied to the slide door 120. As a result, close door biasing force exceeds the open door biasing force, thus the slide door 120 begins to move toward the closing direction, and moves to the closing direction (arrow A2) until it is fully closed.

The drive rotation body 420 pressed by the open door rail 41 is moved downwardly along the closing of the slide door 120. Thus, the converting means 310 applies an upward biasing force to the tread plate 210 and the tread plate 210 is returned to the initial position.

Embodiment 4

The other embodiment of the device for automatically opening and closing the door of the present invention will be described with reference to FIGS. 14-20.

The drive mechanism of the device for automatically opening and closing the door of the present invention is configured in the same way as the drive mechanism of the embodiment 3 described with reference to FIGS. 13 to 16, except that instead of the suspend door rail 140, a close door biasing mechanism is used to apply the close door biasing force.

Figure 17:
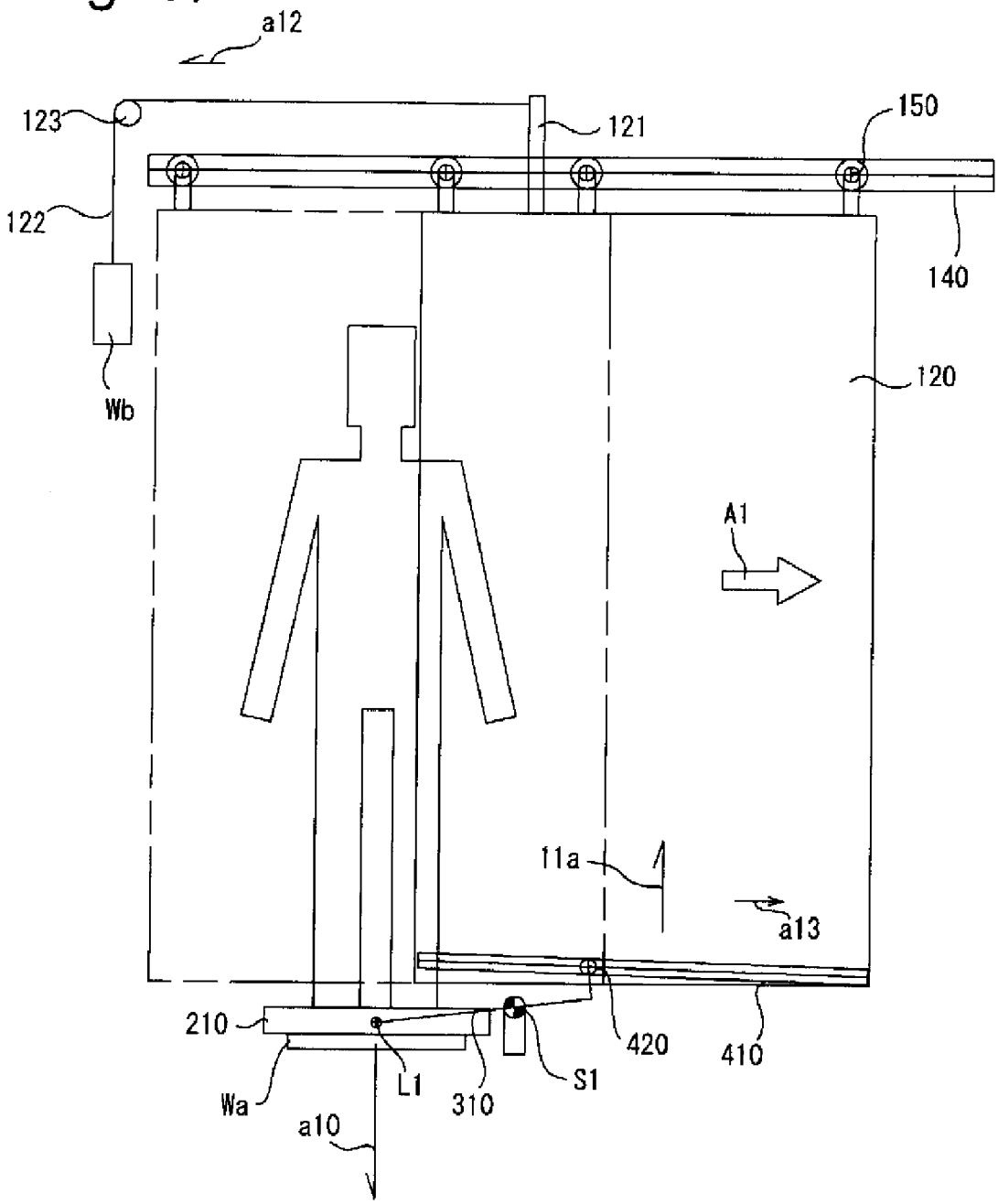
FIG. 17 is a partial front view showing schematically a part of the configuration of the embodiment 4.

In this example, as shown in FIG. 17, the close door biasing mechanism is comprised by fixing one end of a rope 122, which suspends weight Wb, to the suspend member 121 that is fixed to the slide door 120. The rope 122 is led to the downward direction through a pulley 123 arranged close to the closing direction side of the slide door 120 than the suspend member 121. The weight Wb is fixed and suspended to the other end of the rope 122.

The operation of the device for automatically opening and closing the door will be described. As shown in FIG. 17, the open door supplementary mechanism applies the initial biasing force (arrow a10) to the tread plate 210. The initial biasing force works on the door 120 as the pressing up biasing force (arrow a11) through the open door rail 410 from the drive rotation body 420. The pressing up biasing force works as an open door biasing force (arrow a13) on the slide door 120 through the open door rail 410.

The close door biasing mechanism applies the constant close door biasing force as a close door biasing force (arrow a12) to the slide door 120 through the suspend member 121.

When no weight is applied to the tread plate 210, the close door biasing force is only slightly larger than the open door biasing force. Even a part of the body weight of a light weighted person applied to the tread plate 210 will make the closed door 120 to swiftly begin to open and keeps that condition.

Figure 18:
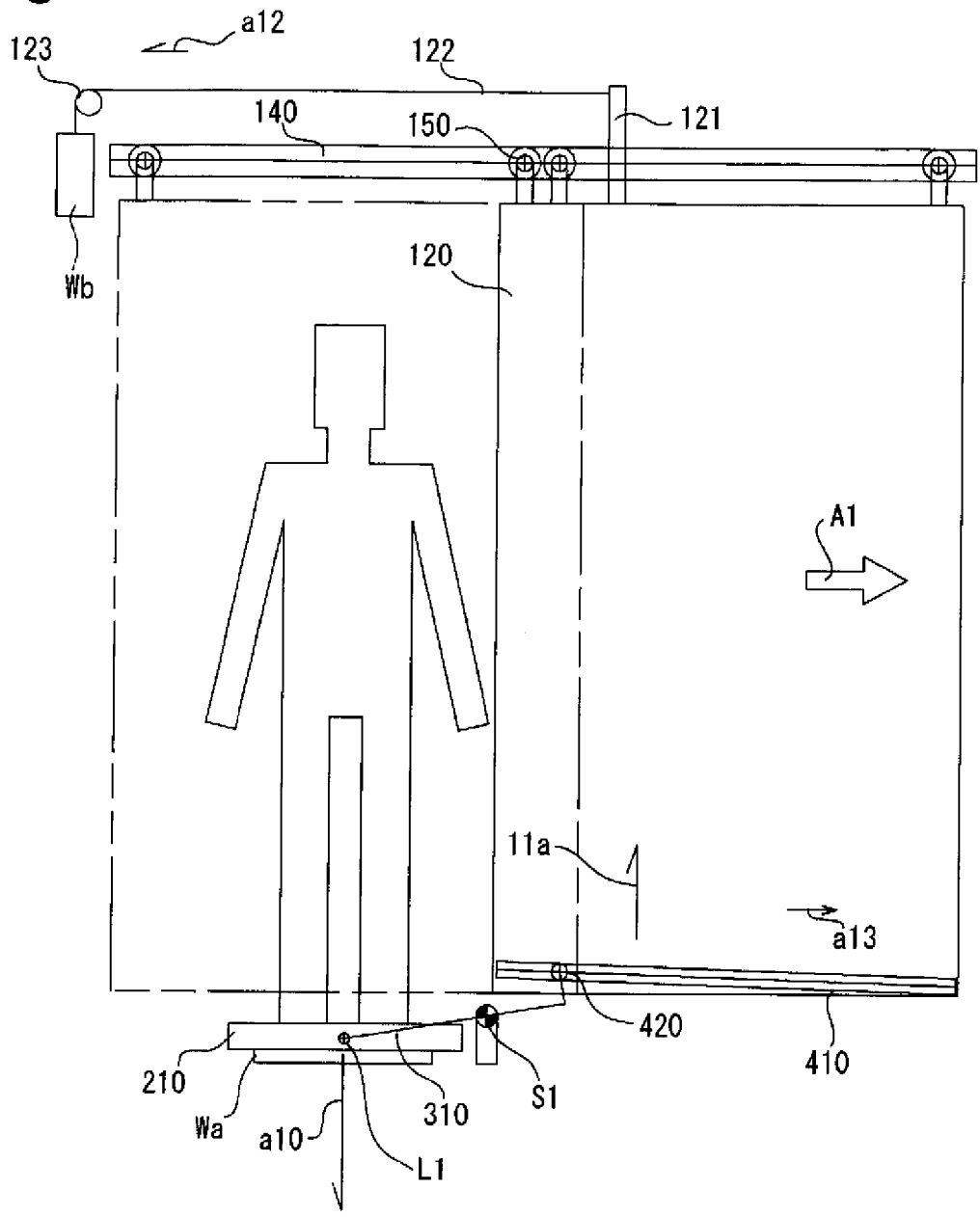
FIG. 18 is a partial front view showing the operational condition of the embodiment 4.
Figure 19:
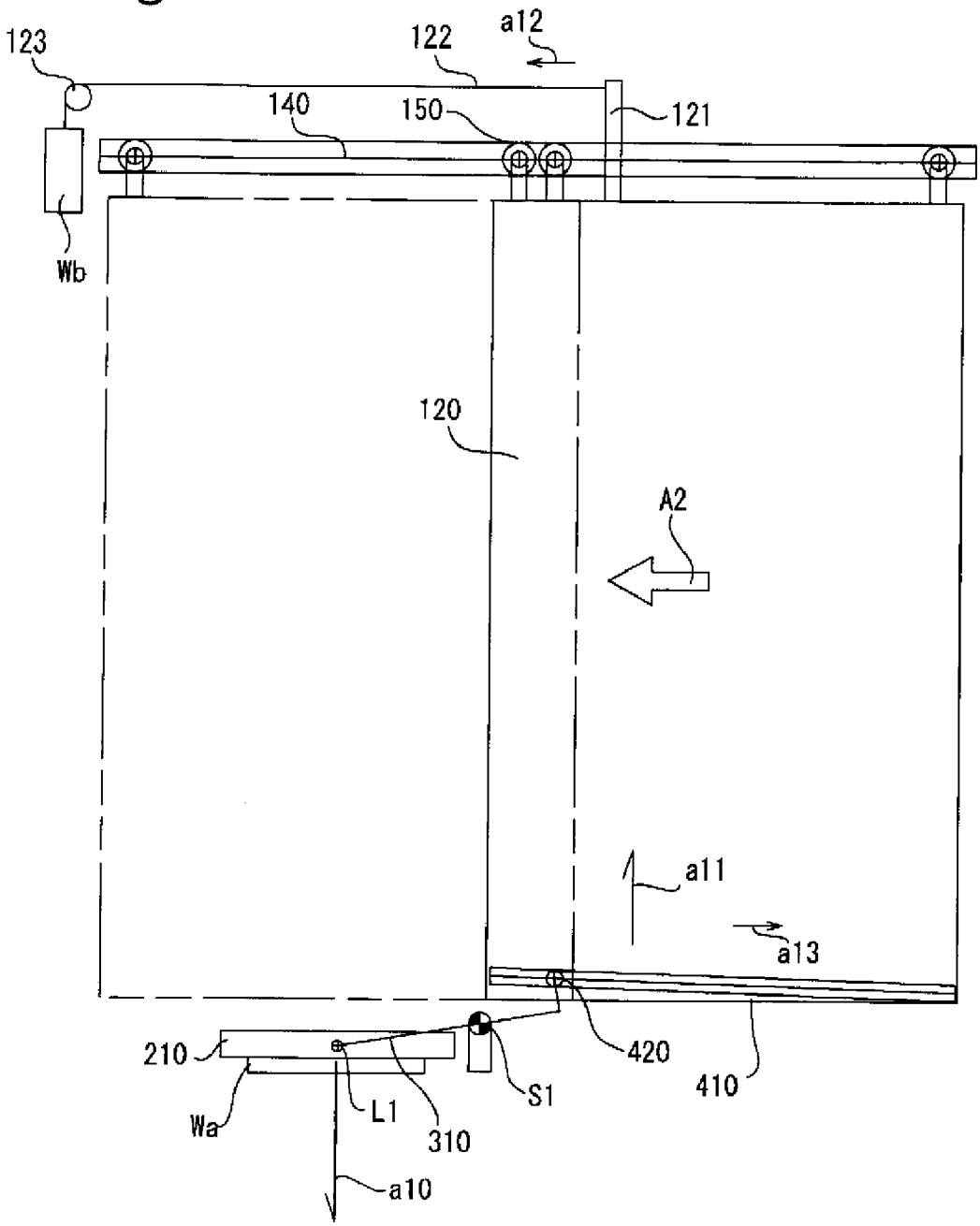
FIG. 19 is a partial front view showing the operational condition of the embodiment 4.

As shown in FIG. 18, when the body weight is applied to the tread plate 210, the pressing up biasing force is increased that operates from the drive rotation body 420 through the open door rail 410. As a consequence, the open door biasing force that works on the slide door 120 is increased. When the open door biasing force exceeds the close door biasing force, the slide door 120 begins to move toward the opening direction (arrow A1). As a result, the slide door 120 is moved to the opening direction until completely opened as shown in FIG. 19.

Figure 20:
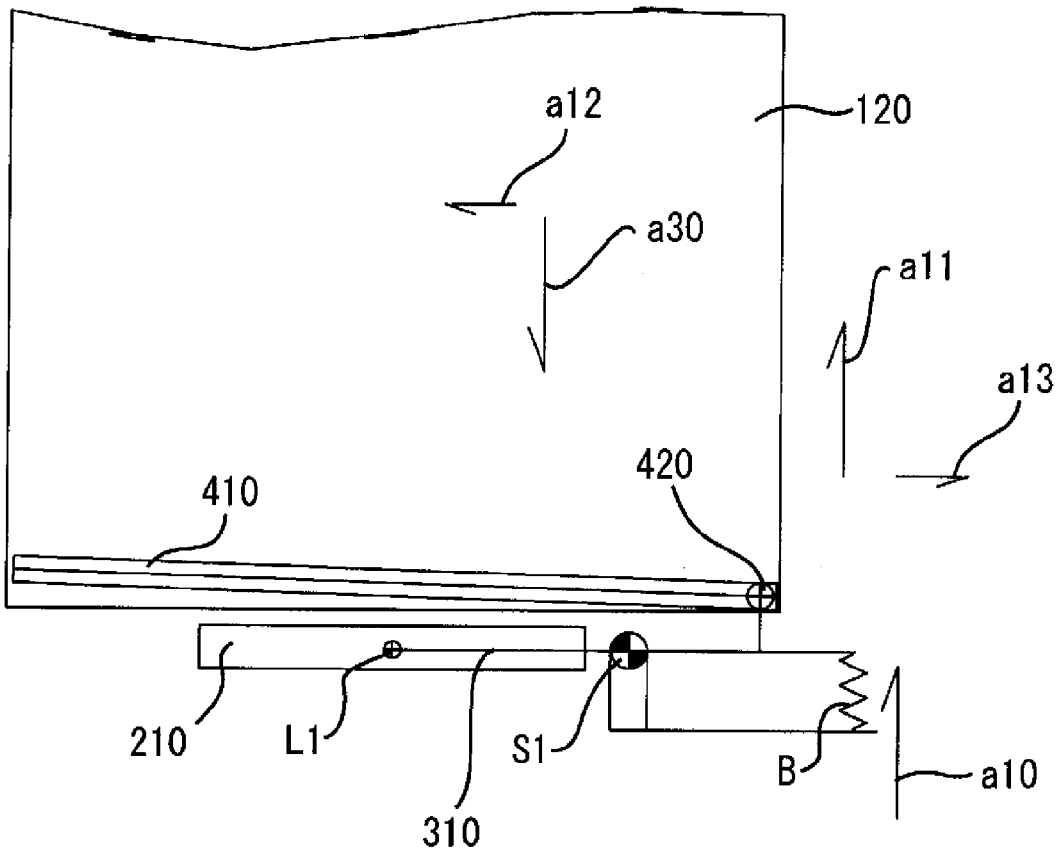
FIG. 20 is a partial front view showing the operational condition of the embodiment 4.

As shown in FIG. 20, when the body weight is no longer applied and the open door biasing force falls below the close door biasing force, the slide door 120 moves toward the closing direction until it is fully closed (arrow A2). When the drive rotation body 420 is lowered along the closing of the slide door 120, the tread plate 210 that is upward biased by the converting mean 310 of the open door mechanism will return to the initial position.

In the embodiment 3 and 4, when the tread plate that is applied with a body weight is depressed, the drive rotation body 420 applies the pressing force to the open door rail 410, thereby moving the slide door 120 toward the opening direction. When the body weight is no longer applied to the tread plate 210, the slide door 120 is moved along with the runner roller 15 to the closing direction of the slide door 120 of the suspend door rail 140. Thus, open and close operation of the door 120 is conducted.

At this time, by applying the pressing force to the open door rail 410 by the open door supplementary mechanism, when the part of the body weight is applied to the tread plate 210, the slide door 120 can be moved to the opening direction. Namely, the difference between the close door biasing force and the open door biasing force on the slide door 120 is minimized when the body weight is not applied to the tread plate 210. When the body weight is applied, the slide door 120 can be swiftly opened. Thus, the door can be opened without causing a person using the door to feel a time lag.

Moreover, the constant pressing up biasing force that constantly operated on the slide door 120 from the drive rotation body 420 decreases the effective weight of the slide door 120. Thus, acceleration can be restrained in closing the door 120 toward the closing direction.

Moreover, as the effective weight of the slide door 120 is decreased by the constant pressing up biasing force, kinetic friction that is generated by the movement of the slide door 120 to the closing direction can be decreased.

Due to the operation of the constant open door biasing force, the constant close door biasing force that constantly operates to the closing direction of the slide door 120 is restrained. Thus, acceleration and movement speed of the slide door 120 toward the closing direction can be reduced.

Moreover, by reducing the weight of the slide door 120 by the pressing up biasing force, kinetic friction generated against the suspend door rail 140 that suspends the slide door 120 is reduced. Thus, the loss of biasing force involved in the opening and closing of the slide door 120 can be reduced.

Embodiment 5

In the embodiments 3 and 4, the case is described where the open door supplementary mechanism works the constant pressing up biasing force on the drive rotation body 420 by means of the weight W, Wa, and Wb. In the embodiment 5, as shown in FIG. 21, a open door supplementary mechanism is configured by using a biasing means such as a spring.

Figure 21:
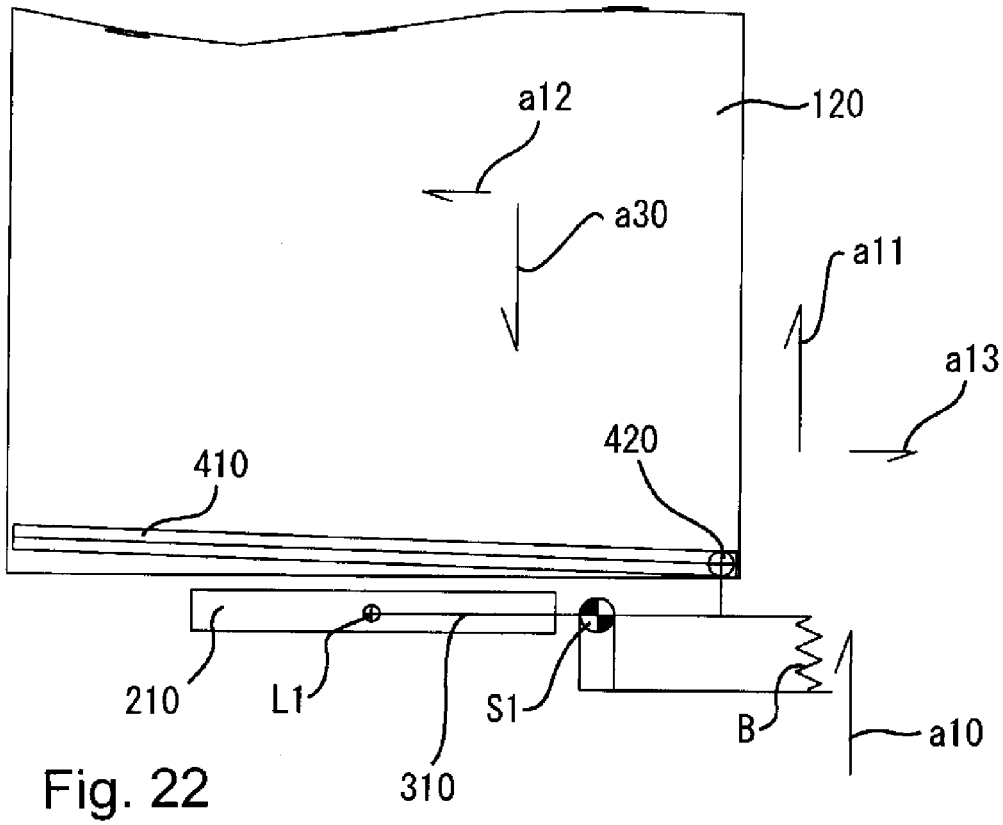
FIG. 21 is a partial front view showing a part of configuration and operational condition of the embodiment 5.

In the embodiment 5, as shown in FIG. 21, the converting means 310 of the open door mechanism is linked (link L1) to the tread plate 210 and is supported at the fulcrum point S1 to be freely displaced by swinging. The converting means 310 is applied with an upward biasing force (arrow a10) by the biasing means B located further in the opening direction side than the fulcrum point S1.

To the lever (converting means) 310, the upward biasing force (arrow a10) that is worked by the biasing means B is operated to bias a point located further in the opening direction side than the fulcrum point S1. The biasing force works on the open door rail 410 as a pressing up biasing force (arrow a11) through the open door rail 410 from the drive rotation body 420. The biasing force then works on the slide door 120 as the open door biasing force (arrow a13). Similar to embodiments 3 and 4, the close door biasing force (arrow a11) constantly operates on the slide door 120.

Accordingly, in the condition where the weight is not applied to the tread plate 210, the same condition is maintained where a small close door biasing force works on the slide door 120. When the body weight is applied to the tread plate 210 (arrow a30), the drive rotation body 420 applies the pressing up biasing force (arrow a11) to the open door rail 410, which operates as the open door biasing force (arrow a13) on the slide door 120. Thus, the slide door 120 is opened. When the body weight is no longer applied to the tread plate 210, the slide door 120 is closed by the close door biasing force (arrow a12).

In embodiments 3 and 4, the open door supplementary mechanism is so configured that weight W, Wa, and Wb apply the constant open door biasing force to the slide door 120. However, it may be configured without using the open door supplementary mechanism.

Figure 22:
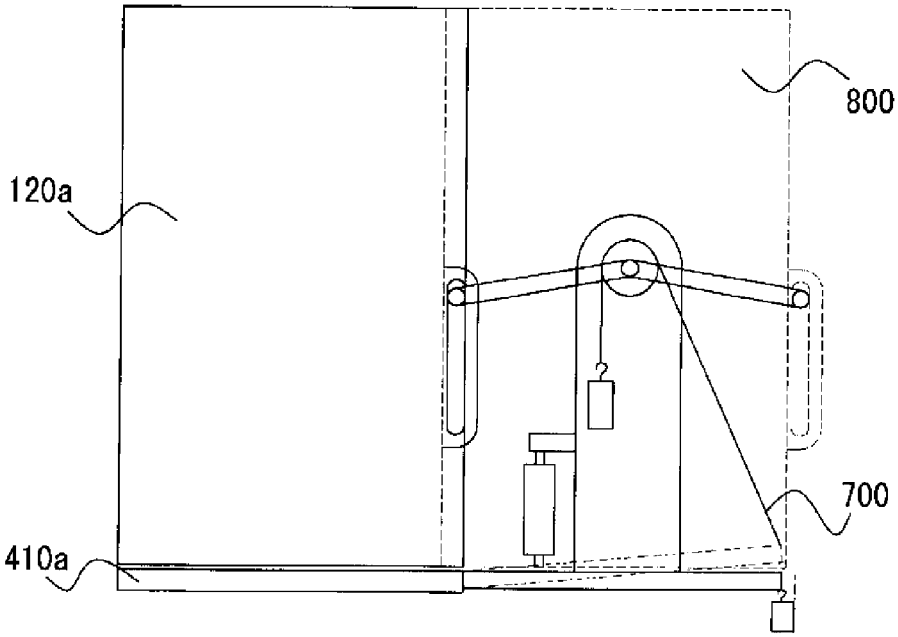
FIG. 22 is a front view showing a closed condition of an automatic door open/close device in one aspect of the conventional product.

In the case of FIG. 22, a door case 800 is located at the right.

In the conventional product shown in FIG. 22, a drive mechanism 700 is located at the door case 800. Thus, a space is required in the front and back for installing the slide door 120. Moreover, for inspection and maintenance, the front and back space of the drive mechanism 700 is necessary and thus, non-moveable fixture cannot be arranged in such a space.

In contrast, in the device for automatically opening and closing the door of the present invention, only a space for installation of the suspend door rail 140 since there is no drive mechanism 700 in the door case 800. After the installation, fixtures may be established in the front and back of the door case 800 as long as the operation of the slide door 120 is not hampered.

INDUSTRIAL APPLICABILITY

The slide door device of the present invention allows the door to open even when a human user or an object passing through the door is slow or stationary. Thus, it is particularly applicable to the passage for transportation of heavy object as in a warehouse and the facility where the user tends to be slow such as care facility.

Moreover, it is applicable to a fireproof door inside a warehouse where it is less frequently used while manual operation for opening and closing is difficult, and also to a humid area such as a large bath where there is the danger of electric leakage since power source like electricity is not required.

Moreover, since the present invention does not generate electromagnetic waves, it is applicable to facility such as hospital that uses machines that are sensitive to electromagnetic waves. Conversely, it is also applicable to the facility that generates electromagnetic waves that can induce false operation.

What is claimed is:

1. A device for automatically opening and closing a door comprising:

a tread plate that is arranged to be freely moveable up and down;

a suspend door rail that is inclined downwardly toward a closing direction of the door;

a door support body that connects the door to the suspend door rail in a freely moveable manner;

an open door rail fixed to the door that is inclined downwardy toward an opening direction of the door; and an open door mechanism with a pressing body that applies a pressing force to the open door rail from below the open door rail wherein the pressing body moveably contacts the open door rail when the tread plate is depressed.

2. A device for automatically opening and closing a door according to claim 1, further characterized as having an open door supplementary mechanism that constantly applies a pressing force to the open rail by the pressing body to the extent that the movement of the door support body to the closing direction of the door is allowed against the suspend door rail.

3. A device for automatically opening and closing a door comprising:

a tread plate that is arranged to be freely moveable up and down;

a door supported to be moveable toward opening and closing directions;

an open door rail fixed to the door that is inclined downwardly toward the opening direction of the door;

an open door mechanism with a pressing body that applies a pressing force to the open door rail from below the open door rail wherein the pressing body moveably contacted to the open door rail when the tread plate is depressed; and a close door biasing mechanism that applies a biasing force to the door toward the closing direction.

4. A device for automatically opening and closing a door according to claim 3 characterized in that the close door biasing mechanism has a pressing biasing force application mechanism that constantly applies a biasing force to the pressing body such that the biasing force presses the pressing body to the open door rail from above.

5. A device for automatically opening and closing a door according to claim 4 characterized in that the close door biasing mechanism has:

a close door rail that is inclined downwardly toward the closing direction of the door and is configured to be separate from the door; and a supplementary pressing mechanism that applies a constant pressing biasing force from above to the close door rail by a supplementary pressing body that is contacted to be freely moveable to the close door rail and is provided to a lever that is supported to be freely swingable to the door.

6. A device for automatically opening and closing a door according to claim 3 characterized in that the close door biasing mechanism has an upper side pressing body that holds the open door rail from above with the pressing body and is contacted to the open door rail to be freely moveable, and applies a biasing force to the door toward the closing direction by applying the biasing force that pushes the upper part pressing body to the open door rail from the above.

7. A device for automatically opening and closing door according to claim 3, characterized in having a open door supplementary mechanism that constantly applies a pressing biasing force to the open door rail by the pressing body such that the pressing biasing force is to the extent that allows movements of the door that is being biased by the close door biasing mechanism toward the closing direction.

* * * * *